US008523969B2

(12) United States Patent
Sakashita et al.

(10) Patent No.: US 8,523,969 B2
(45) Date of Patent: Sep. 3, 2013

(54) INDOOR UNIT OF AIR CONDITIONER

(75) Inventors: Akihiko Sakashita, Osaka (JP); Tsuyoshi Yokomizo, Osaka (JP); Morimichi Okada, Fukuoka (JP)

(73) Assignee: Daikin Industries, Ltd., Osaka (JP)

( * ) Notice: Subject to any disclaimer, the term of this patent is extended or adjusted under 35 U.S.C. 154(b) by 79 days.

(21) Appl. No.: 12/863,144

(22) PCT Filed: Jan. 16, 2009

(86) PCT No.: PCT/JP2009/000156

§ 371 (c)(1),
(2), (4) Date: Jul. 15, 2010

(87) PCT Pub. No.: WO2009/090887

PCT Pub. Date: Jul. 23, 2009

(65) Prior Publication Data

US 2011/0048684 A1 Mar. 3, 2011

(30) Foreign Application Priority Data

Jan. 16, 2008 (JP) ..... 2008-007311

(51) Int. Cl.
*B01D 46/00* (2006.01)

(52) U.S. Cl.
USPC ..... 55/283; 62/303; 165/DIG. 11; 55/289; 55/295; 55/296

(58) Field of Classification Search
USPC ..... 62/303–316, 908; 165/4–10, 95, 165/119, DIG. 10, DIG. 11, DIG. 76–DIG. 91; 55/289, 295–300; 119/303–316
See application file for complete search history.

(56) References Cited

U.S. PATENT DOCUMENTS

| | | | | |
|---|---|---|---|---|
| 6,729,154 | B2 * | 5/2004 | Takashima et al. | 62/317 |
| 7,063,128 | B2 * | 6/2006 | You | 165/89 |
| 8,034,138 | B2 * | 10/2011 | Okada et al. | 55/289 |
| 2007/0060036 | A1 * | 3/2007 | Shibuya et al. | 454/187 |

FOREIGN PATENT DOCUMENTS

| | | | |
|---|---|---|---|
| JP | 2005-177323 | A | 7/2005 |
| JP | 2006-71121 | A | 3/2006 |
| JP | 2006-153313 | A | 6/2006 |
| JP | 2006-214663 | A | 8/2006 |
| JP | 2007-038215 | A | 2/2007 |
| JP | 2007-130628 | A | 5/2007 |
| JP | 2007-271174 | A | 10/2007 |
| JP | 2007-309584 | A | 11/2007 |
| JP | 2007-315626 | A | 12/2007 |

OTHER PUBLICATIONS

A partial English translation of JP-2007-271174-A, dated Oct. 18, 2007.

* cited by examiner

*Primary Examiner* — Duane Smith
*Assistant Examiner* — Thomas McKenzie
(74) *Attorney, Agent, or Firm* — Birch, Stewart, Kolasch & Birch, LLP.

(57) ABSTRACT

An air filter (30) intermittently rotates by a predetermined rotation angle at each time, while being in contact with a bristle portion (51*b*) of a rotating brush (51). Accordingly, dust on the air filter (30) is scraped by the bristle portion (51*b*). The brush member (51) rotates about an axial center of a shaft (51*a*) at each stop of the intermittent rotation of the air filter (30), to come into contact with a cleaning brush member (52). According, dust on the brush member (51) is removed by the cleaning brush member (52).

9 Claims, 13 Drawing Sheets

INDOOR UNIT OF AIR CONDITIONER

TECHNICAL FIELD

The present invention relates to an indoor unit of an air conditioner including a brush member configured to come into contact with an air filter to remove dust therefrom.

BACKGROUND ART

Among indoor units of air conditioners each having an air filter at an air inlet, those provided with a dust removing section for removing dust trapped on the air filter have been known.

In an indoor unit shown in PATENT DOCUMENT 1, for example, a rotating brush as a dust removing section is provided upstream of (i.e., below) an air filter. The air filter is in the shape of a disc. The rotating brush is made of a cylindrical shaft and a plurality of bristles provided on the entire outer circumferential surface of the shaft. In this indoor unit, both of the air filter and the rotating brush rotate with the bristles of the rotating brush in contact with the upstream surface (i.e., the lower surface) of the air filter, thereby causing dust to be scraped from the air filter by the bristles.

CITATION LIST

Patent Document

PATENT DOCUMENT 1: Japanese Patent Publication No. 2006-71121

SUMMARY OF THE INVENTION

Technical Problem

In the indoor unit of PATENT DOCUMENT 1 described above, especially in an environment with a relatively large amount of dust, the dust removing performance (i.e., the dust scraping capability) of the rotating brush might immediately degrade. The dust removing performance (i.e., the dust scraping capability) of the rotating brush degrades as the amount of trapped dust (i.e., the amount of scraped dust) increases. Accordingly, as removal of dust from the entire air filter is continued, the amount of dust trapped by the rotating brush increases, and the dust removing performance significantly degrades. When the amount of trapped dust reaches its maximum, the rotating brush cannot scrape dust any more.

It is therefore an object of the present invention to provide an indoor unit of an air conditioner which includes a brush member configured to come into contact with an air filter to remove dust therefrom and can maintain a high dust removing performance as long as possible.

Solution to the Problem

A first aspect of the present invention is directed to an indoor unit of an air conditioner in which an indoor heat exchanger (22), an indoor fan (21), and an air filter (30) disposed on an inlet side of the indoor fan (21) are provided in a casing (10). The indoor unit includes: a brush member (51) configured to come into contact with the air filter (30) to scrape dust from the air filter (30); and a cleaning brush member (52) configured to come into contact with the brush member (51) to remove dust from the brush member (51). In the indoor unit, scraping operation of scraping dust from a predetermined area of the air filter (30) at each time with the brush member (51) and removing operation of removing dust from the brush member (51) with the cleaning brush member (52) after each completion of the scraping operation, are performed.

In this aspect, while air sucked into the casing (10) by the indoor fan (21) passes through the air filter (30), dust contained in the air is trapped on the air filter (30). In operation of removing dust from the air filter (30), first, the brush member (51) and the air filter (30) are brought into contact with each other to scrape (remove) dust on a predetermined area of the air filter (30) with the brush member (51). Then, the brush member (51) and the cleaning brush member (52) are brought into contact with each other, thereby removing dust on the brush member (51) with the cleaning brush member (52). Subsequently, the air filter (30) and the brush member (51) are brought into contact with each other again, thereby scraping dust on another area of the air filter (30) with the brush member (51). Thereafter, dust on the brush member (51) is removed by the cleaning brush member (52). In this manner, in this aspect, dust removal from the air filter (30) and dust removal from the brush member (51) are performed for the predetermined area of the air filter (30) at each time.

In a second aspect of the present invention, the indoor unit of the first aspect further includes: a drive section (40) configured to intermittently move the air filter (30) and the brush member (51) relative to each other for the predetermined area of the air filter (30) at each time to scrape dust from the air filter (30) with the brush member (51): and a brush drive section (53) configured to bring the brush member (51) and the cleaning brush member (52) into contact with each other after each stop of the intermittent relative movement of the air filter (30) and the brush member (51), to remove dust from the brush member (51) with the cleaning brush member (52).

In this aspect, first, the air filter (30) and the brush member (51) move relative to each other, while being in contact with each other, thereby scraping (removing) dust on the air filter (30) with the brush member (51). This relative movement of these components is stopped after dust is scraped from a predetermined area of the air filter (30). For example, the air filter (30) stops after moving over a predetermined area relative to the brush member (51). That is, the predetermined area of the air filter (30) passes over the brush member (51). When the relative movement of the air filter (30) and the brush member (51) stops, the brush member (51) rotates to come into contact with the cleaning brush member (52), thereby removing dust from the brush member (51). Thereafter, the brush member (51) rotates to come into contact with the air filter (30) again. Subsequently, a predetermined area of the air filter (30) passes over the brush member (51), and then the air filter (30) stops. In this manner, relative movement of the air filter (30) and the brush member (51) and a stop of the relative movement are alternately repeated for the entire air filter (30), and at each stop of the relative movement, dust on the brush member (51) is removed by the cleaning brush member (52).

In a third aspect of the present invention, in the indoor unit of the second aspect, the air filter (30) has a disc shape, the brush member (51) includes a shaft (51*a*) and a bristle portion (51*b*) provided on an outer circumferential surface of the shaft (51*a*) and configured to scrape dust, is located upstream of the air filter (30), and extends in a radial direction of the air filter (30). The drive section (40) intermittently rotates the air filter (30) by a predetermined rotation angle corresponding to the predetermined area at each time, with the bristle portion (51*b*) of the brush member (51) being in contact with the air filter (30). The brush drive section (53) rotates the brush member (51) about an axial center of the shaft (51*a*) after each stop of the intermittent rotation of the air filter (30) by the drive section (40), to remove dust from the brush member (51) with the cleaning brush member (52).

In this aspect, first, the air filter (30) rotates, while being in contact with the bristle portion (51*b*) of the brush member (51), thereby removing dust with the brush member (51). After rotating by a predetermined rotation angle (i.e., moving over a predetermined area), the air filter (30) stops. When the air filter (30) stops, the brush member (51) rotates to come into contact with the cleaning brush member (52), thereby removing dust from the brush member (51). Thereafter, the brush member (51) rotates, and the bristle portion (51*b*) of the brush member (51) comes into contact with the air filter (30) again. Then, the air filter (30) rotates by a predetermined rotation angle (i.e., moves over a predetermined area) again, and stops. In this manner, in this aspect, rotation and stop of the air filter (30) are alternately performed. At each stop of the air filter (30), dust on the brush member (51) is removed by the cleaning brush member (52).

In a fourth aspect of the present invention, in the indoor unit of the second or third aspect, the predetermined area in the intermittent relative movement of the air filter (30) and the brush member (51) by the drive section (40) is adjusted depending on an amount of dust attached to the air filter (30).

In this aspect, as the amount of dust attached to the air filter (30) increases, the predetermined area of the air filter (30) is reduced. Specifically, as the amount of dust attached to the air filter (30) increases, the amount of relative movement of the air filter (30) and the brush member (51) at each time decreases, and the area of the air filter (30) from which dust is scraped by the brush member (51) at each time decreases. When the amount of dust attached to the air filter (30) is large, the amount of dust which needs to be scraped in each relative movement of the air filter (30) and the brush member (51) is also large. In this case, since the amount of dust scraped by the brush member (51) at each time has a limitation, the dust might not be scraped any more. Then, although the air filter (30) and the brush member (51) are relatively moved to scrape dust, dust on the air filter (30) cannot be scraped and remains. As described above, in this aspect, as the amount of dust attached to the air filter (30) increases, the area from which dust is scraped by the brush member (51) at each time is reduced. Thus, scraping of dust from this area by the brush member (51) can be ensured.

In addition, in a case where the air filter (30) having a disc shape intermittently rotates by a predetermined rotation angle at each time, the predetermined rotation angle is adjusted depending on the amount of dust attached to the air filter (30). For example, as the amount of dust attached to the air filter (30) increases, the rotation angle in the intermittent rotation of the air filter (30) is reduced. That is, as the amount of dust attached to the air filter (30) increases, the amount of rotation of the air filter (30) at each time decreases, and the area from which dust is scraped by the brush member (51) at each time decreases.

In a fifth aspect of the present invention, in the indoor unit of the third aspect, the brush drive section (53) is configured to rotate the brush member (51) after completion of the rotation of the air filter (30) by the drive section (40), to remove dust from the brush member (51) with the cleaning brush member (52).

In this aspect, after rotation of the air filter (30), i.e., after a series of cleaning operation in which dust is removed from the air filter (30), dust on the brush member (51) is removed by the cleaning brush member (52). Accordingly, at a start of next cleaning operation for the air filter (30), dust is already removed from the brush member (51).

In a sixth aspect of the present invention, in the indoor unit of the third aspect, the bristle portion (51*b*) of the brush member (51) is made of pile fabric.

In this aspect, the bristle portion (51*b*) of the brush member (51) is made of pile fabric, the bristle portion (51*b*) have relatively short bristles. Accordingly, the distance between the air filter (30) and the brush member (51) can be reduced.

In a seventh aspect of the present invention, the indoor unit of the sixth aspect, the bristle portion (51*b*) of the brush member (51) is made of inclined pile in which bristles of the bristle portion (51*b*) are inclined in a direction opposite a direction of the relative movement of the air filter (30).

In this aspect, when the air filter (30) moves relative to the brush member (51), for example, the bristles of the bristle portion (51*b*) are inclined in the direction opposite the direction of the movement of the air filter (30). That is, the bristles of the bristle portion (51*b*) are inclined in the opposite direction to the movement of the air filter (30). On the other hand, when the brush member (51) moves relative to the air filter (30), the bristles of the bristle portion (51*b*) are inclined in the same direction as the direction of the movement of the brush member (51). Accordingly, dust on the air filter (30) can be easily scraped by the bristle portion (51*b*).

In an eighth aspect of the present invention, in the indoor unit of the third aspect, the bristle portion (51*b*) of the brush member (51) is made of inclined pile fabric of pile fabric in which bristles of the bristle portion (51*b*) are inclined in a direction opposite a direction of the relative movement of the air filter (30), and the cleaning brush member (52) has a bristle portion (52*b*) made of inclined pile fabric in which bristles of the bristle portion (52*b*) are inclined in a direction opposite a direction of inclination of the bristles of the bristle portion (51*b*) of the brush member (51), and configured to come into contact with the bristle portion (51*b*) of the brush member (51) to remove dust from the bristle portion (51*b*).

In this aspect, when the air filter (30) moves relative to the brush member (51), for example, the bristles of the bristle portion (51*b*) are inclined in the direction opposite the direction of the movement of the air filter (30). That is, the bristles of the bristle portion (51*b*) are inclined in the opposite direction to the movement of the air filter (30). On the other hand, when the brush member (51) moves relative to the air filter (30), the bristles of the bristle portion (51*b*) are inclined in the same direction as the direction of the movement of the brush member (51). Accordingly, dust on the air filter (30) can be easily scraped by the brush member (51). In addition, the bristles of the bristle portion (52*b*) of the cleaning brush member (52) are inclined in the direction opposite to the inclination of the bristles of the bristle portion (51*b*) of the brush member (51). Accordingly, dust on the brush member (51) can be easily scraped by the cleaning brush member (52).

In a ninth aspect of the present invention, in the indoor unit of the third aspect, the bristle portion (51*b*) of the brush member (51) is made of inclined pile fabric of pile fabric in which bristles of the bristle portion (51*b*) are inclined in a direction, and the drive section (40) is configured to stop after rotating the air filter (30) in a direction opposite a direction of inclination of bristles of the bristle portion (51*b*) and then reversely rotating the air filter (30) by a predetermined rotation angle.

In this aspect, the air filter (30) rotates in a direction opposite to the inclination of the bristles of the bristle portion (51*b*) of the brush member (51). Accordingly, dust on the air filter (30) is removed by the brush member (51). After the air filter (30) rotates by a predetermined rotation angle, the air filter (30) rotates in the opposite direction (i.e., in the same direction as the inclination of the bristles of the bristle portion (51*b*) of the brush member (51)), and then stops. Accordingly, dust already removed, or almost separated, from the air filter (30) can be reliably trapped on (attached to) the bristle portion (51*b*) of the brush member (51).

In a tenth aspect of the present invention, the indoor unit of the first aspect further includes: a dust container (60) located upstream of the air filter (30), including the brush member (51) and the cleaning brush member (52), and configured to contain dust removed by the cleaning brush member (52); and a dust transfer section (80) configured to introduce air blowing from the indoor fan (21) into the dust container (60), and transfer dust in the dust container (60) to a predetermined place, together with the blowing air.

In this aspect, dust on the air filter (30) is removed by the brush member (51), and dust trapped on the brush member (51) is removed by the cleaning brush member (52). This removed dust is contained in the dust container (60). In this aspect, air blowing from the indoor fan (21) enters the dust container (60), and dust is transferred, together with the air, to a predetermined place (e.g., to outside the casing (10)). That is, dust removed from the air filter (30) is transferred to another place by utilizing air blowing from the indoor fan (21).

Advantages of the Invention

As described above, in the first and second aspects, scraping operation of scraping dust with the brush member (51) is performed on the predetermined area of the air filter (30) at each time. After each scraping operation, dust on the brush member (51) is removed by the cleaning brush member (52). Specifically, the air filter (30) and the brush member (51) are intermittently moved relative to each other for the entire air filter (30). At each stop of the intermittent movement, dust on the brush member (51) is removed by the cleaning brush member (52). That is, in these aspects, dust removal from the air filter (30) and dust removal from the brush member (51) are alternately performed for the entire air filter (30). Accordingly, the area of the air filter (30) from which dust is scraped by the brush member (51) at each time can be reduced. The amount of dust scraped by the brush member (51) at a time has a limitation. In view of this limitation, the area from which dust is scraped by the brush member (51) at a time is reduced, thereby preventing degradation of the dust removing performance of the brush member (51) due to an increase in the amount of trapped dust, and further, a failure in scraping dust by the brush member (51) when the amount of trapped dust reaches its maximum. Accordingly, a high dust removing performance (i.e., dust scraping capability) of the brush member (51) can be maintained for the entire air filter (30). As a result, the efficiency in removing dust from the air filter (30) can be increased, thereby ensuring dust removal from the entire air filter (30).

In the third aspect, the air filter (30) having a disc shape is rotated by a predetermined rotation angle relative to the brush member (51) at each time, thereby intermittently moving the air filter (30) and the brush member (51) relative to each other. Accordingly, unlike a case where the air filter (30) having a rectangular shape is slidably moved, it is unnecessary to provide space for moving the air filter (30). This configuration can reduce the size of the indoor unit.

Further, in the fourth aspect, the amount of intermittent relative movement of the air filter (30) and the brush member (51) is adjusted depending on the amount of dust attached to the air filter (30). Specifically, in this aspect, the area of the air filter (30) from which dust is intermittently removed is adjusted depending on the amount of dust attached to the air filter (30). Accordingly, when the amount of dust attached to the air filter (30) is large, the amount of the relative movement (i.e., the predetermined area) at each time is reduced to reduce the area from which dust is scraped by the brush member (51) at each time. In this manner, the amount of dust scraped by the brush member (51) at each time decreases, thereby ensuring that degradation of the dust removing performance of the brush member (51) or failure in scraping dust by the brush member (51) is avoided. As a result, dust removal from the entire air filter (30) is further ensured.

In the fifth aspect, after a series of cleaning operation in which the air filter (30) is rotated to remove dust from the air filter (30), dust on the brush member (51) is removed by the cleaning brush member (52). Accordingly, at a start of next cleaning operation, no dust is attached to the brush member (51). Thus, at the start of cleaning operation for the air filter (30), a high dust removing performance can be obtained. As a result, the time necessary for cleaning the air filter (30) can be reduced.

In the sixth aspect, the bristle portion (51*b*) of the brush member (51) is made of pile fabric. Accordingly, since the bristle portion (51*b*) has short bristles, it is possible to ensure removal of dust from the air filter (30), while reducing the area occupied by the brush member (51).

In the seventh aspect, the bristle portion (51*b*) of the brush member (51) is made of inclined pile fabric in which bristles of the bristle portion (51*b*) are inclined in a direction opposite a direction of relative movement of the air filter (30). This configuration ensures removal of dust from the air filter (30). As a result, it is possible to increase the efficiency in removing dust from the air filter (30), while reducing the area occupied by the brush member (51).

In the eighth aspect, the cleaning brush member (52) includes the bristle portion (52*b*) made of inclined pile fabric in which bristles of the bristle portion (52*b*) are inclined in a direction opposite the inclination of the bristles of the bristle portion (51*b*) of the brush member (51). This configuration ensures removal of dust from the brush member (51).

In the ninth aspect, the air filter (30) is temporarily rotated in the same direction as the inclination of the bristles of the bristle portion (51*b*) of the brush member (51), and then is stopped. This operation ensures trapping (attachment) of dust almost separated from the air filter (30) to the bristle portion (51*b*) of the brush member (51). Accordingly, it is possible to ensure removal of dust, without failing in removing dust from the air filter (30). As a result, the efficiency in removing dust can be increased.

In the tenth aspect, the dust container (60) configured to contain dust removed from the air filter (30) is provided, and dust in the dust container (60) is transferred to a predetermined place, together with air blowing from the indoor fan (21). This configuration eliminates the need for additionally providing a transfer section such as a suction fan in order to easily transfer removed dust to a place where the dust can be easily disposed. In this manner, it is possible to increase the efficiency in disposing dust removed from the air filter (30) without an increase in the size of the unit.

BRIEF DESCRIPTION OF THE DRAWINGS

FIG. 12(A) shows a state in filter cleaning operation, and FIG. 12(B) shows a state in normal operation.

FIG. 15(C) shows a state in normal operation.

DESCRIPTION OF REFERENCE CHARACTERS

Figure 1:
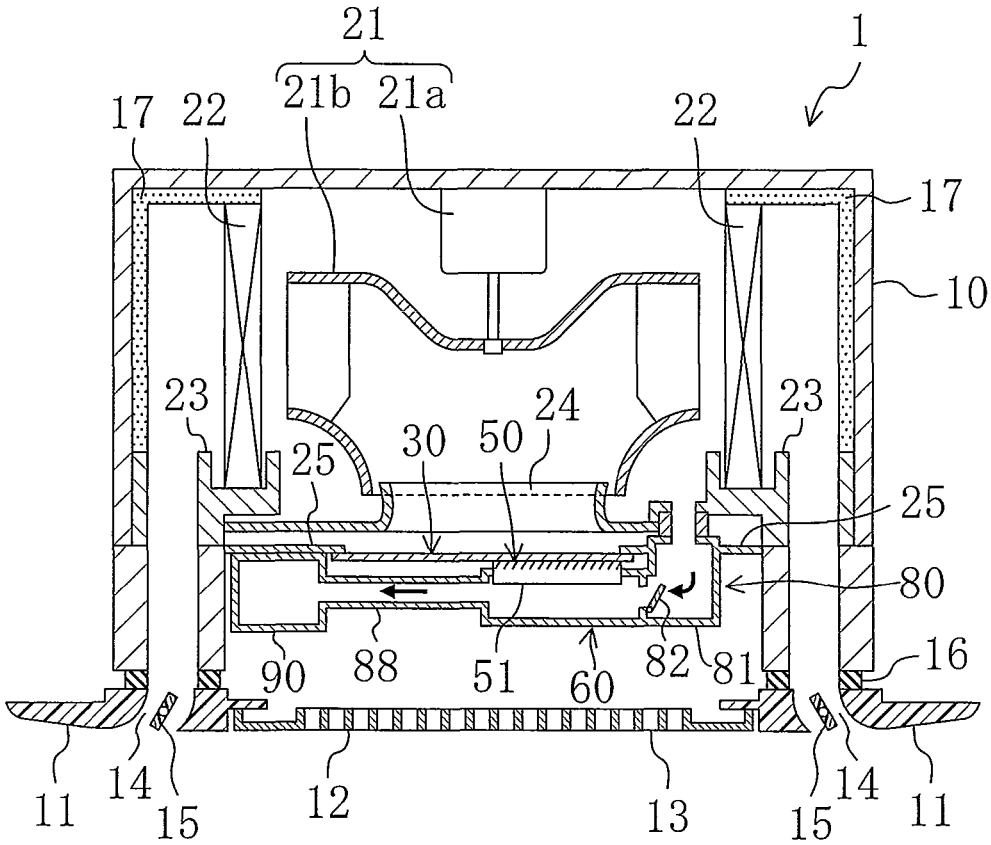
FIG. 1 is a vertical cross-sectional view illustrating a structure of an indoor unit according to an embodiment.

1 indoor unit
10 casing
21 indoor fan
22 indoor heat exchanger
30 air filter
40 filter drive section (drive section)
51 rotating brush (brush member)
51*a* shaft
51*b* bristle portion
52 cleaning brush (cleaning brush member)
52*b* bristle portion
53 brush drive section
60 dust container
80 dust transfer section

DESCRIPTION OF EMBODIMENTS

An embodiment of the present invention will be described in detail hereinafter with reference to the drawings.

An indoor unit (1) of this embodiment constitutes part of an air conditioner, and is placed on a ceiling of a room. The air conditioner includes a refrigerant circuit connecting a compressor, an outdoor heat exchanger, and an expansion valve provided in an outdoor unit, to an indoor heat exchanger (22) provided in the indoor unit (1), using pipes. The refrigerant circuit performs a vapor compression refrigeration cycle by reversibly circulating a refrigerant. The air conditioner performs cooling operation in which the indoor heat exchanger (22) in the refrigerant circuit functions as an evaporator, and heating operation in which the indoor heat exchanger (22) in the refrigerant circuit functions as a condenser.

<Configuration of Indoor Unit >

Figure 2:
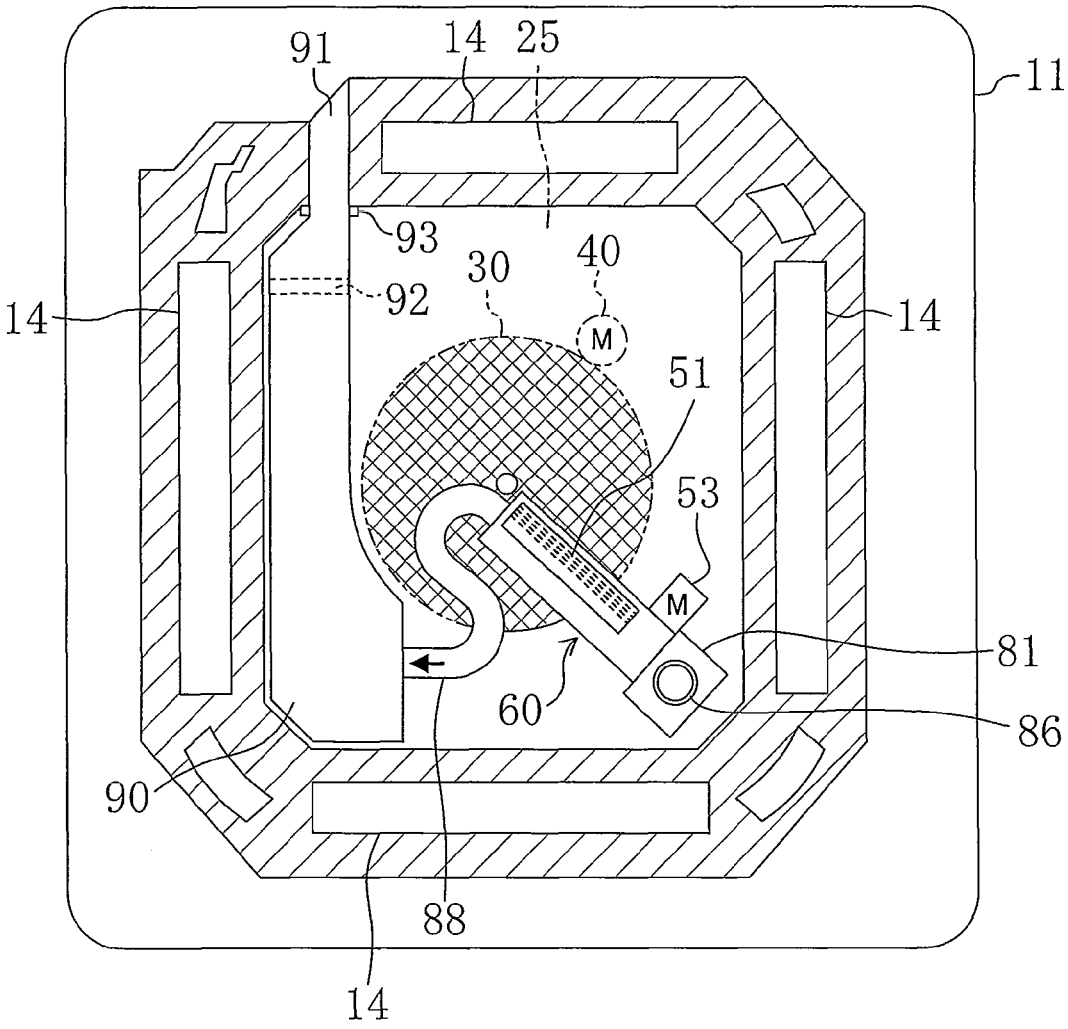
FIG. 2 is a lateral cross-sectional view illustrating the structure of the indoor unit of the embodiment when viewed from above.

As shown in FIGS. 1 and 2, the indoor unit (1) includes a casing (10) and a decorative panel (11). In the casing (10), the indoor heat exchanger (22), a drain pan (23), an indoor fan (21), an air filter (30), a filter drive section (40), a dust removing section (50), a dust container (60), a dust transfer section (80), and a dust collection box (90) are provided.

The casing (10) is in the shape of a substantially rectangular parallelepiped box which is open at the bottom. A heat insulator (17) is laminated on an inner surface of the casing (10). The casing (10) is disposed with the bottom thereof inserted in an opening of a ceiling plate.

The decorative panel (11) is in the shape of a rectangular plate. When viewed in plan, the decorative panel (11) is slightly larger than the casing (10). The decorative panel (11) is attached to the casing (10) to cover the lower portion of the casing (10) with a sealing member (16) sandwiched therebetween. The decorative panel (11), when attached to the casing (10), is exposed in the room.

The decorative panel (11) has one inlet (13) and four outlets (14). The inlet (13) is rectangular-shaped, and is formed in the center of the decorative panel (11). A suction grille (12) provided with slits is fitted in the inlet (13). Each of the outlets (14) is in the shape of a narrow rectangle. The outlets (14) are respectively formed along the sides of the decorative panel (11). An adjuster plate (15) for adjusting the direction of airflow is provided at each of the outlets (14). The adjuster plate (15) rotates to adjust the direction of airflow (i.e., the direction of blowing air).

The indoor fan (21) is a so-called turbo fan. The indoor fan (21) is disposed near the center of the casing (10) and above the inlet (13). The indoor fan (21) includes a fan motor (21*a*) and an impeller (21*b*). The fan motor (21*a*) is fixed to a top plate of the casing (10). The impeller (21*b*) is connected to a rotation axis of the fan motor (21*a*). A bell mouth (24) communicating with the inlet (13) is provided below the indoor fan (21). The bell mouth (24) divides space in the casing (10) located upstream of the indoor heat exchanger (22) into a room near the indoor fan (21) and a room near the suction grille (12). The indoor fan (21) is configured to blow air sucked from below through the bell mouth (24) in a radial direction.

The indoor heat exchanger (22) is configured as a cross-fin type fin-and-tube heat exchanger. When viewed in plan, the indoor heat exchanger (22) is in the shape of a rectangular frame, and is disposed to surround the indoor fan (21). In the indoor heat exchanger (22), a refrigerant and indoor air (blown air) sent by the indoor fan (21) exchange heat.

The drain pan (23) is disposed below the indoor heat exchanger (22). The drain pan (23) receives drainage generated as a result of condensation of moisture in the air in the indoor heat exchanger (22). The drain pan (23) is provided with a drain pump (not shown) for discharging the drainage. The drain pan (23) is inclined so that the drainage is collected to part of the drain pan at which the drain pump is provided.

A partition plate (25) is provided below the bell mouth (24). The partition plate (25) vertically divides space between the bell mouth (24) and the suction grille (12). Specifically, the partition plate (25) divides space upstream of the indoor heat exchanger (22) into a room near the indoor heat exchanger (22) including the bell mouth (24), and a room near the suction grille (12).

Figure 3:
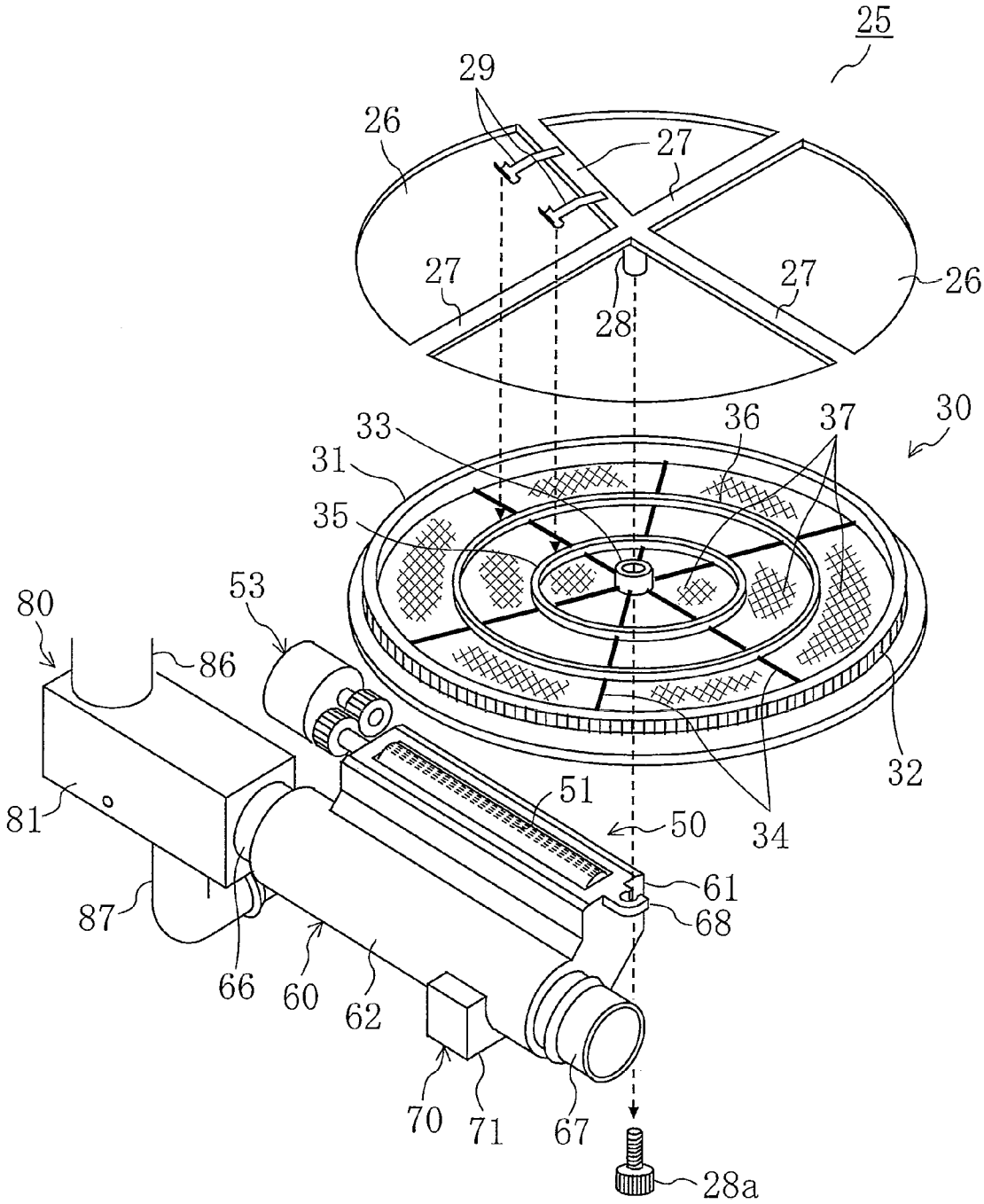
FIG. 3 is a perspective view illustrating structures of a partition plate, an air filter, and a dust container according to the embodiment.

A vent (26) through which the air sucked through the inlet (13) flows into the bell mouth (24) is formed in the center of the partition plate (25). As shown in FIG. 3, the circular vent (26) is divided into four fan-shaped vents by four radially extending radial members (27). The radial members (27) are connected to each other at the center of the circular vent, and a cylindrical filter rotation axis (28) protrudes downward from the center. The filter rotation axis (28) is a rotation axis about which the air filter (30) rotates. Two filter holders (29) are formed on one of the radial members (27).

As shown in FIG. 3, the air filter (30) is disposed below the partition plate (25), and is in the shape of a disc which is large enough to cover an inlet of the bell mouth (24). Specifically, the air filter (30) includes an annular filter body (31) and a mesh member (37). A gear (32) is formed on an outer circumferential surface of the filter body (31). A cylindrical axis receiver (33) supported by six radial ribs (34) is formed in the center of the annular filter body (31). Specifically, each of the radial ribs (34) radially extends from the axis receiver (33). An inner annular rib (35) and an outer annular rib (36) coaxial with the filter body (31) are formed radially inside the filter body (31). The outer annular rib (36) has a larger diameter than the inner annular rib (35). The mesh member (37) entirely covers the inside of the filter body (31). The air sucked through the inlet (13) passes through the mesh member (37) of the air filter (30), and flows into the bell mouth (24). At this time, the dust contained in the air is trapped on the mesh member (37).

The air filter (30) is biased downward by the filter holders (29) abutting the radial ribs (35, 36). Therefore, the air filter (30) is pressed onto a rotating brush (51) of a dust removing section (50) described later. This improves the efficiency of dust removal by the dust removing section (50).

Figure 4:
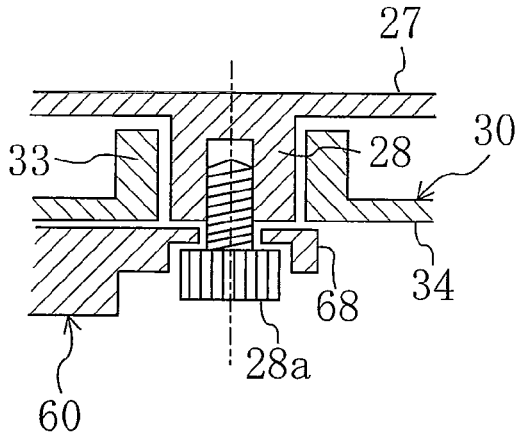
FIG. 4 is a cross-sectional view illustrating an attachment of the air filter according to the embodiment.

As also shown in FIG. 4, the air filter (30) is attached, with the axis receiver (33) fitted on the filter rotation axis (28) of the partition plate (25). The air filter (30) is rotatable about the filter rotation axis (28). The dust container (60) is disposed below the air filter (30). With the axis receiver (33) of the air filter (30) fitted on the filter rotation axis (28), a filter attachment (68) of the dust container (60) is fixed to the filter rotation axis (28) of the partition plate (25) with a fixing screw (28*a*). Thus, the air filter (30) is held between the partition plate (25) and the dust container (60).

A filter drive section (40) for rotating the air filter (30) is provided near the air filter (30) (see, FIG. 2). The filter drive section (40) constitutes a drive section for relatively moving the air filter (30) and the rotating brush (51).

Figure 5:
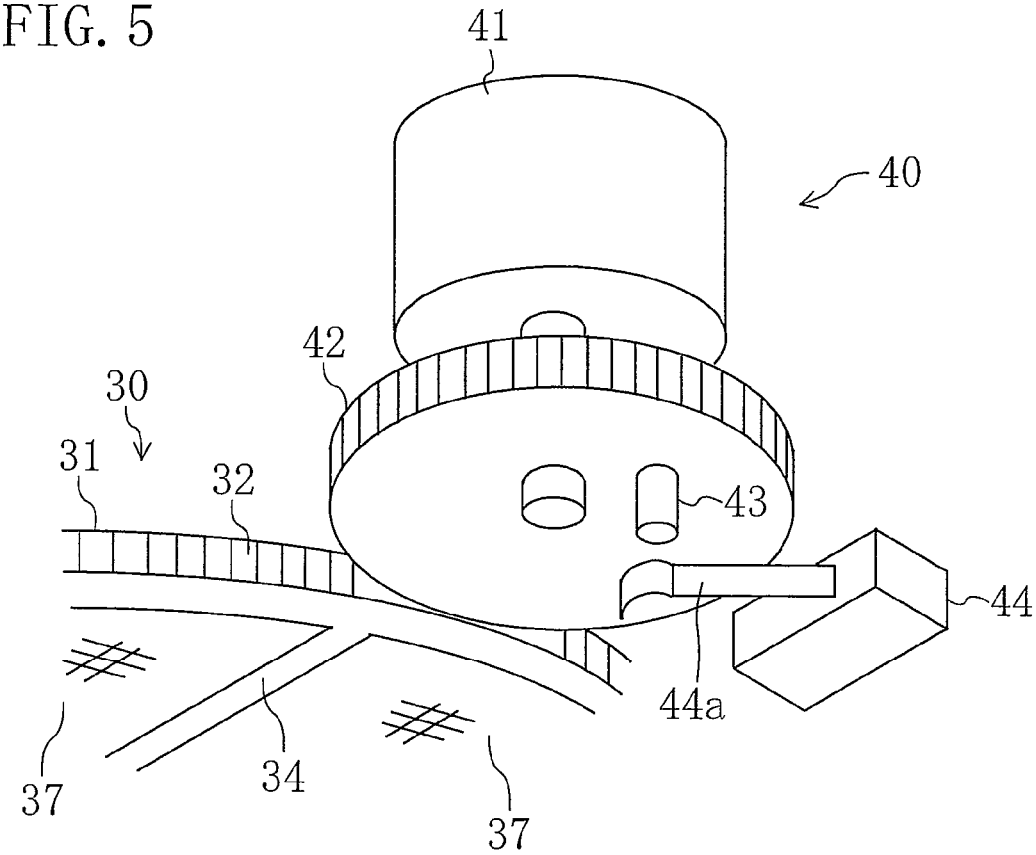
FIG. 5 is a perspective view illustrating a structure of a filter drive section according to the embodiment.

Specifically, the filter drive section (40) includes a filter drive motor (41) and a limit switch (44) as shown in FIG. 5. A drive gear (42) is attached to a drive shaft of the filter drive motor (41), and the drive gear (42) engages with the gear (32) of the filter body (31). A switch actuator (43) which is a tab is formed on one of the surfaces of the drive gear (42). The switch actuator (43) actuates a lever (44*a*) of the limit switch (44) in response to the rotation of the drive gear (42). The limit switch (44) detects the actuation of the lever (44*a*) by the switch actuator (43). That is, the switch actuator (43) and the limit switch (44) detect the rotational position of the drive gear (42).

The dust removing section (50), the dust container (60), and the dust transfer section (80) will be described with reference to FIGS. 6-11. The dust removing section (50) and other components are arranged below the partition plate (25) and the air filter (30) (see, FIGS. 1 and 2).

The dust removing section (50) is provided to remove dust trapped on the air filter (30). The dust removing section (50) includes a rotating brush (51), a cleaning brush (52), and a brush drive section (53). The rotating brush (51) and the cleaning brush (52) constitute a brush member (51) and a cleaning brush member (52), respectively, according to the present invention.

Figure 8:
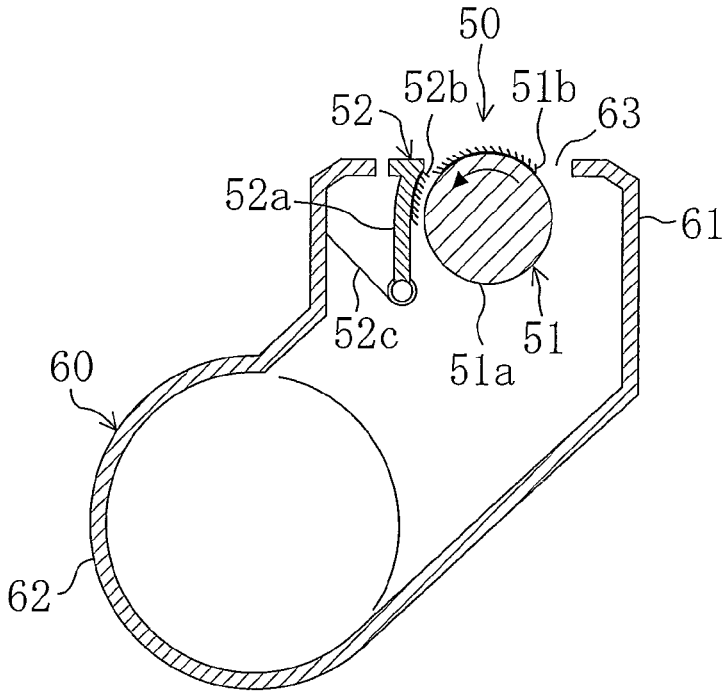
FIG. 8 is a lateral cross-sectional view illustrating the structure of the dust container of the embodiment.

As shown in FIG. 8, the rotating brush (51) and the cleaning brush (52) are provided in a brush receiving opening (63) of the dust container (60) described later.

The rotating brush (51) includes a narrow cylindrical shaft (51*a*) and a bristle portion (51*b*) attached to an outer circumferential surface of the shaft (51*a*). The bristle portion (51*b*) is made of a plurality of bristles. The bristle portion (51*b*) covers part of the circumference of the shaft (51*a*), and extends in the longitudinal direction of the shaft (51*a*). The cleaning brush (52) is disposed rearward of the rotating brush (51).

The cleaning brush (52) includes a body (52*a*), a bristle portion (52*b*), and a spring (52*c*). The body (52*a*) is a plate-like member, and has the same length as the shaft (51*a*) of the rotating brush (51). The plate surface of the body (52*a*) faces the outer circumferential surface of the rotating brush (51). An upper portion of the body (52*a*) is curved to correspond to the outer circumferential surface of the shaft (51*a*) of the rotating brush (51). The bristle portion (52*b*) is provided on the curved portion of the body (52*a*) to extend in the longitudinal direction of the body (52*a*). The spring (52*c*) is attached to a lower end portion of the body (52*a*), and to an inner wall of the dust container (60). That is, the body (52*a*) is supported by the spring (52*c*).

The rotating brush (51) and the cleaning brush (52) have a length equal to or larger than the radius of the air filter (30). The rotating brush (51) and the cleaning brush (52) are arranged to extend radially outward from the center of the air filter (30).

Figure 6:
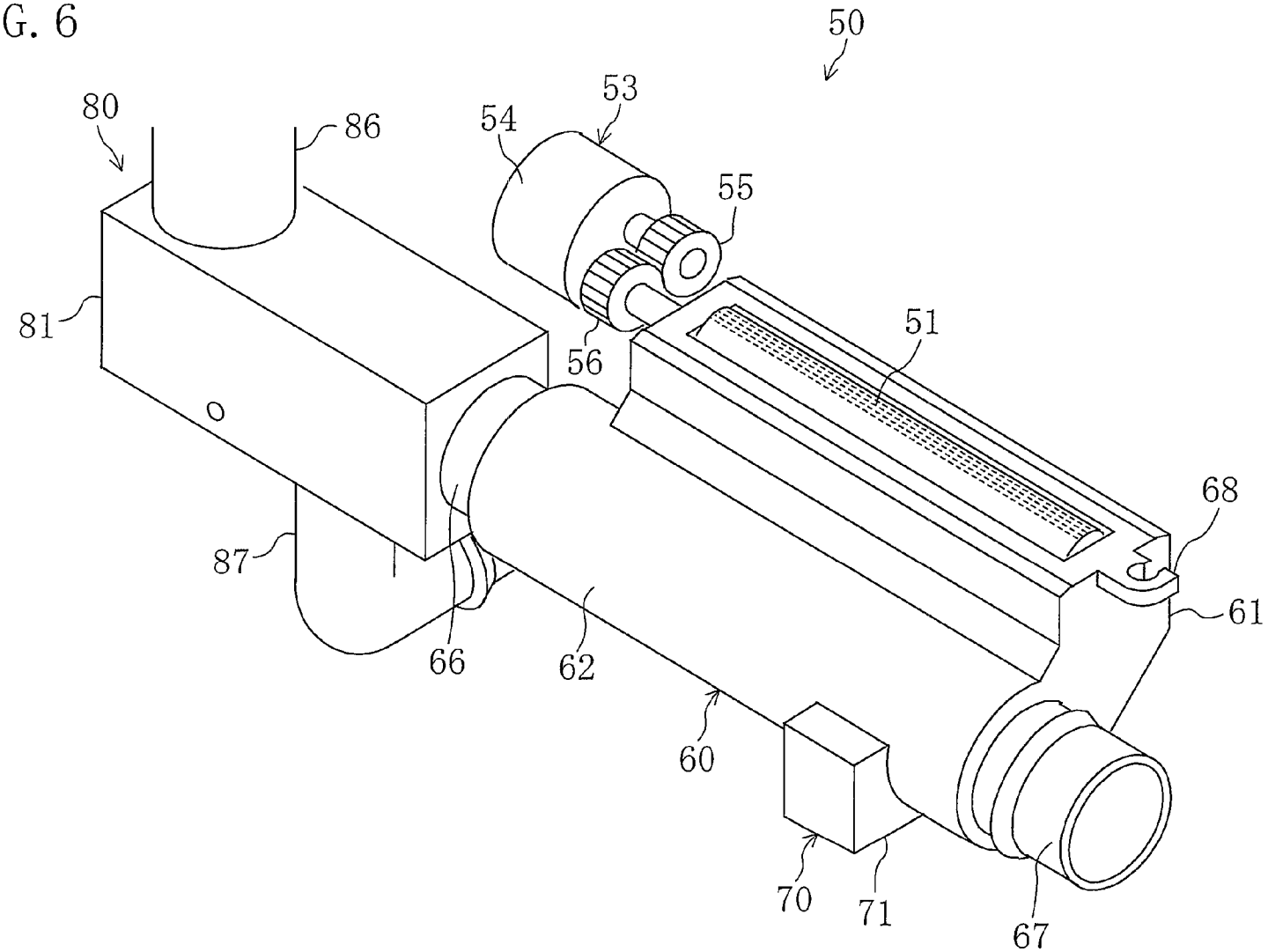
FIG. 6 is a perspective view illustrating structures of a dust removing section and the dust container according to the embodiment when viewed from above.
Figure 7:
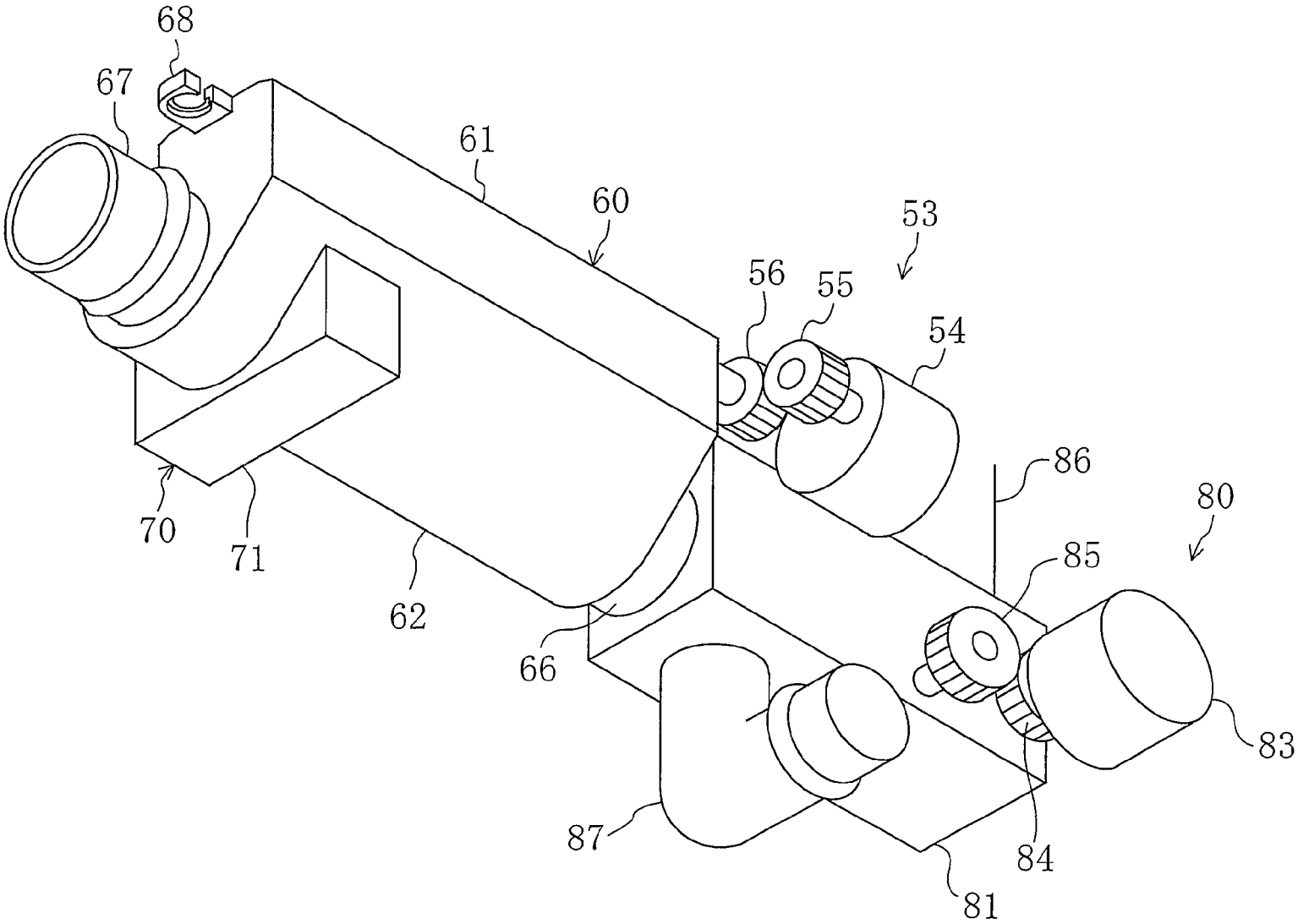
FIG. 7 is a perspective view illustrating the structures of the dust removing section and the dust container of the embodiment when viewed from below.

The rotating brush (51) is configured in such a manner that dust is removed from the mesh member (37) when the bristle portion (51*b*) comes into contact with the mesh member (37) of the rotating air filter (30). The rotating brush (51) is driven by the brush drive section (53) to rotate in a reversible manner. As shown in FIGS. 6 and 7, the brush drive section (53) includes a brush drive motor (54), and a drive gear (55) and a driven gear (56) engaging with each other. The drive gear (55) is attached to a drive shaft of the brush drive motor (54), and the driven gear (56) is attached to an end of the shaft (51*a*) of the rotating brush (51). This structure drives the rotating brush (51) to rotate. Although detailed description will be given later, the brush drive section (53) rotates the rotating brush (51) to switch the state of the rotating brush (51) between a state in which the bristle portion (51*b*) of the rotating brush (51) is in contact with the air filter (30) and a state in which the bristle portion (51*b*) is separated from the air filter (30).

The bristle portion (52*b*) of the cleaning brush (52) is configured to come into contact with the bristle portion (51*b*) of the rotating brush (51) as the rotating brush (51) is rotated by the brush drive section (53). The contact allows dust to be removed from the bristle portion (51*b*) of the rotating brush (51). Specifically, the cleaning brush (52) removes the dust from the rotating brush (51) to clean the rotating brush (51). The dust removal action of the rotating brush (51) and the cleaning brush (52) will be described later.

The bristle portions (51*b*, 52*b*) of the rotating brush (51) and the cleaning brush (52) are made of so-called pile fabric. The pile fabric is hairy fabric obtained by weaving an extra fiber (pile yarn) into base fabric, and has relatively short bristles projecting from the base fabric. The pile fabric is inclined pile fabric in which the bristles are inclined in a certain direction.

Specifically, the bristles of the bristle portion (51*b*) of the rotating brush (51) are inclined to the left from the shaft (51*a*) in FIG. 8. In other words, the bristles of the bristle portion (51*b*) are inclined in a direction opposite the direction of rotation of the air filter (30). When the air filter (30) rotates in the direction opposite the direction of inclination of the bristles of the bristle portion (51*b*), the dust on the mesh member (37) is efficiently scraped. On the other hand, when the air filter (30) rotates in the same direction as the direction of inclination of the bristles of the bristle portion (51*b*), the dust on the mesh member (37) is not scraped, but the dust trapped on the bristle portion (51*b*) is removed. The bristles of the bristle portion (52*b*) of the cleaning brush (52) are inclined downward from the body (52*a*) in FIG. 8. Specifically, the bristles of the bristle portion (52*b*) are inclined in the direction opposite the direction of clockwise rotation of the rotating brush (51) in FIG. 8.

The dust container (60) contains the dust removed from the rotating brush (51) by the cleaning brush (52). The dust container (60) is a columnar container bent substantially in the shape of rotated V when viewed from the side (from the right in FIG. 6). An upper portion of the dust container (60) is a removal portion (61) for removing the dust on the air filter (30), and a lower portion of the dust container (60) is a container portion (62) for containing the dust removed from the air filter (30).

A brush receiving opening (63) is formed in the top surface of the removal portion (61) to extend in the longitudinal direction of the top plate, and the rotating brush (51) and the cleaning brush (52) are arranged in the brush receiving opening (63) as described above. The above-described filter attachment (68) is formed at a side surface of the removal portion (61). A lower (bottom) part of the container portion (62) is convex curved. The dust removed from the rotating brush (51) by the cleaning brush (52) falls and accumulates in the curved part of the container portion (62). The container portion (62) is open at both ends (66, 67) thereof in the longitudinal direction. The first end (66) of the container portion (62) is connected to a damper box (81) of a dust transfer section (80) described later. The second end (67) is connected to a transfer duct (88) of the dust transfer section (80) described later.

Figure 9:
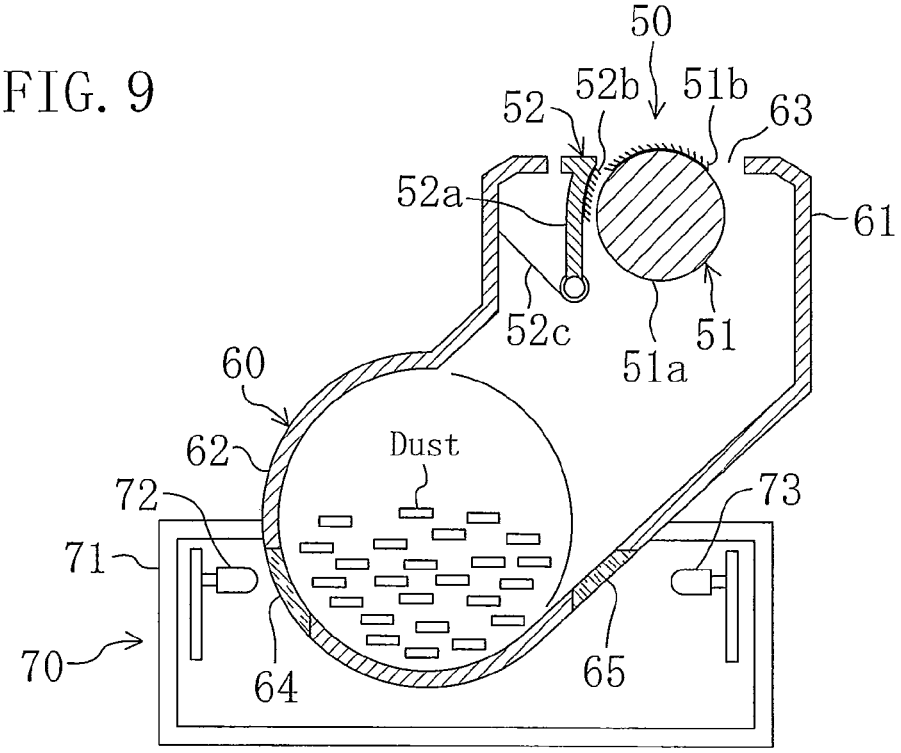
FIG. 9 is a lateral cross-sectional view illustrating a structure of a dust amount detection section according to the embodiment, showing a relationship with the dust container.

As shown in FIG. 9, the dust container (60) includes a dust amount detection section (70) for detecting the amount of dust in the container portion (62). The dust amount detection section (70) includes a sensor box (71). The sensor box (71) is disposed close to the second end (67) of the container portion (62) of the dust container (60) (see, FIGS. 6 and 7). The sensor box (71) extends laterally across the container portion (62) to cover the bottom of the container portion (62). The sensor box (71) contains an LED (72) and a phototransistor (73). The LED (72) and the phototransistor (73) are arranged to face each other so as to laterally sandwich the container portion (62). On the other hand, a first transparent window (64) and a second transparent window (65) are formed in a wall of the container portion (62) at positions corresponding to the LED (72) and the phototransistor (73), respectively.

In the dust amount detection section (70), the intensity of light sequentially transmitted from the LED (72) through the first transparent window (64) and the second transparent window (65) is detected by the phototransistor (73). Depending on the detected light intensity, the amount of dust (i.e., the density of the dust) contained in the container portion (62) is detected. Specifically, when the amount of the contained dust is small, transmittance of light from the first transparent window (64) to the second transparent window (65) in the container portion (62) is high, and thus, the detected light intensity is high. On the other hand, if the amount of the contained dust is large, the transmittance of light from the first transparent window (64) to the second transparent window (65) in the container portion (62) is low, and thus, the detected light intensity is low. In this manner, the dust amount detection section (70) can determine that the container portion (62) is filled with dust when the light intensity decreases to a predetermined level or less.

As shown in FIGS. 2, 6, and 7, the dust transfer section (80) includes the damper box (81), the transfer duct (88), an entrance duct (86), and a suction duct (87).

Figure 10:
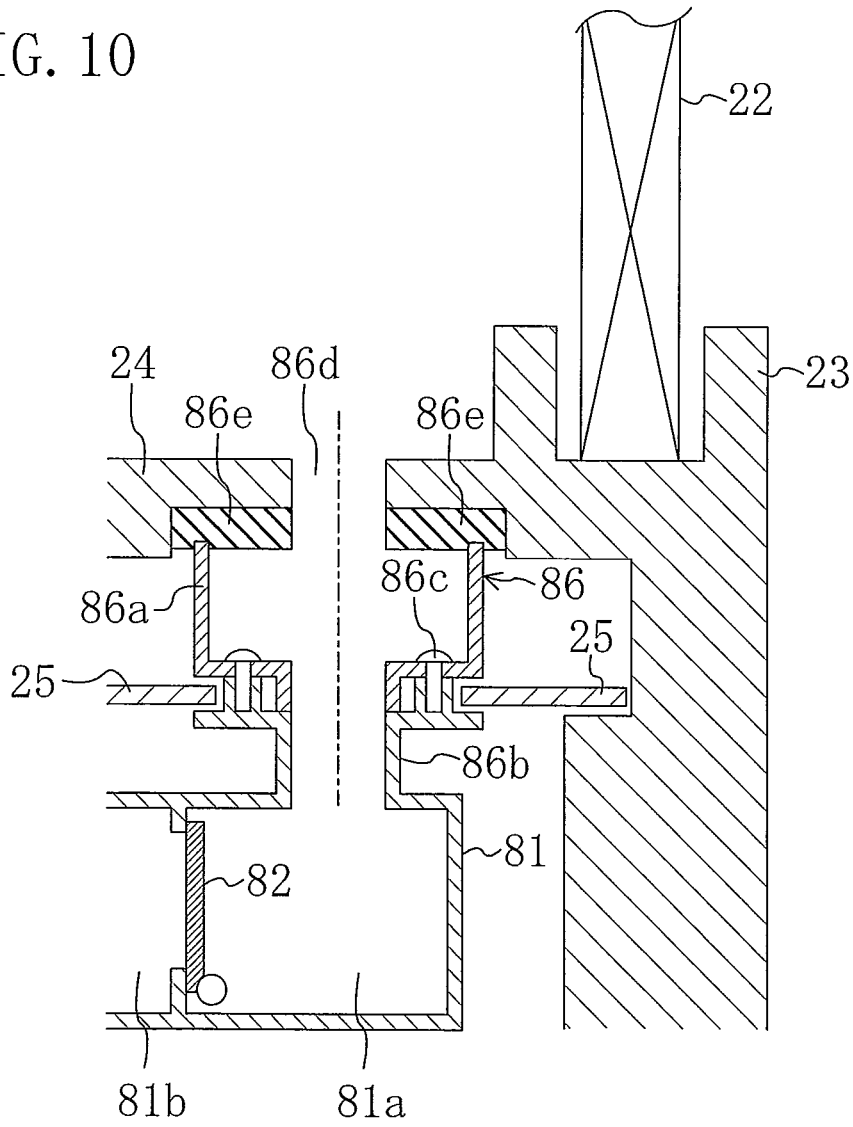
FIG. 10 is a cross-sectional view illustrating a structure of a main portion of a dust transfer section according to the embodiment.
Figure 11:
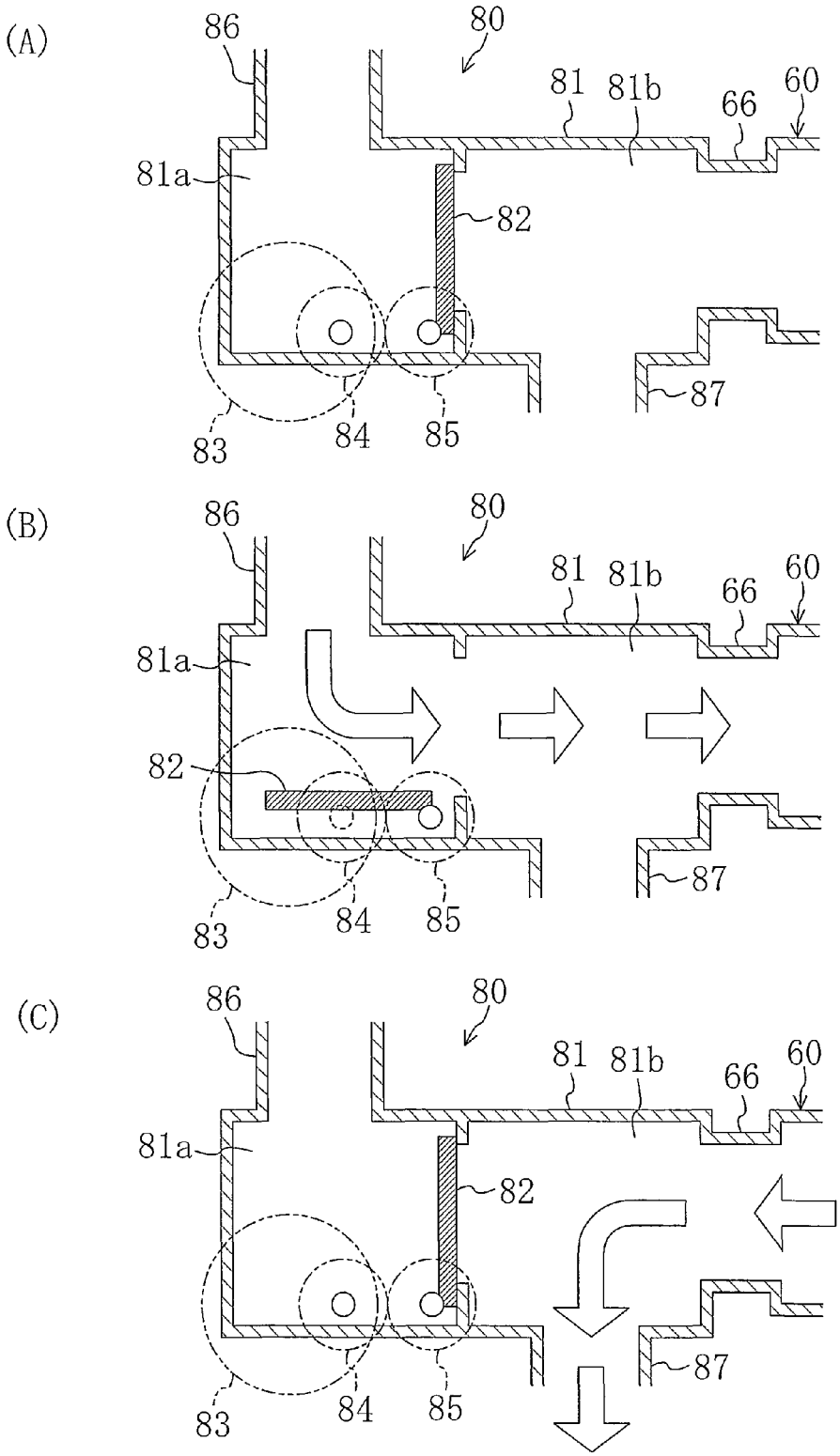
FIG. 11 is a cross-sectional view illustrating a structure of a main portion of the dust transfer section of the embodiment.

The damper box (81) is in the shape of a rectangular parallelepiped extending in the longitudinal direction of the container portion (62) of the dust container (60). The first end (66) of the container portion (62) is connected to a longitudinal end of the damper box (81). As shown in FIGS. 10 and 11, the damper box (81) contains a damper (82) as a opening/closing member. Closing the damper (82) divides space inside the damper box (81) in the longitudinal direction. Specifically, the space inside the damper box (81) is divided into a first room (81*a*) and a second room (81*b*). As described above, the first end (66) of the container portion (62) is connected to the second room (81*b*).

As shown in FIGS. 7 and 11, the dust transfer means (80) includes a damper drive motor (83) for driving the damper (82) to open/close, a drive gear (84), and a driven gear (85). The drive gear (84) is provided to a drive shaft of the damper drive motor (83), and the driven gear (85) is attached to a rotation axis of the damper (82). The drive gear (84) and the driven gear (85) engage with each other. In this structure, the rotation of the damper drive motor (83) is transferred to the rotation axis of the damper (82) through the gears (84, 85). This allows the damper (82) to rotate about the rotation axis, thereby opening/closing the damper (82).

The entrance duct (86) is connected to an upper surface of the damper box (81), and communicates with the first room (81*a*). As shown in FIG. 10, the entrance duct (86) extends vertically upward from the damper box (81), and penetrates the partition plate (25). The entrance duct (86) includes an upstream duct (86*a*) and a downstream duct (86*b*), both of which are circular when viewed in a lateral cross-sectional view. The two ducts (86*a*, 86*b*) are vertically connected to each other with fixing screws (86*c*). A lateral cross-sectional area (i.e., a flow path area) of the upstream duct (86*a*) is larger than a lateral cross-sectional area (i.e., a flow path area) of the downstream duct (86*b*). A lower end portion (i.e., a lower end portion in FIG. 10) of the downstream duct (86*b*) is connected to the damper box (81). An upper end portion (i.e., an upper end portion in FIG. 10) of the upstream duct (86*a*) is in contact with a horizontally extending member of the bell mouth (24) with a sealing member (86*e*) interposed therebetween. An inlet (86*d*) as a through hole is formed in the horizontally extending member of the bell mouth (24). The upstream duct (86*a*) communicates with space including the indoor fan (21) through the inlet (86*d*). Specifically, the entrance duct (86) brings the air blowing from the indoor fan (21) into the damper box (81).

A junction between the upstream duct (86*a*) and the downstream duct (86*b*) of the entrance duct (86) is located in a through hole formed in the partition plate (25). Specifically, the ducts (86*a*, 86*b*) are connected in such a manner that a bottom plate of the upstream duct (86*a*) and an upper flange of the downstream duct (86*b*) sandwich the rim of the through hole in the partition plate (25). The junction and the sealing member (86*e*) are configured in such a manner that the entrance duct (86), the damper box (81), and the dust container (60) rotate together about the axial center of the entrance duct (86).

An inlet end of the suction duct (87) is connected to the lower surface of the damper box (81), and communicates with the second room (81*b*). The other outlet end of the suction duct (87) is connected to a cleaner insertion port (not shown) formed in the decorative panel (11). The cleaner insertion port is provided to receive a hose of a cleaner, etc., inserted therein for suction. The suction duct (87) is made of a flexible tube.

As shown in FIGS. 1 and 2, one end of the transfer duct (88) is connected to the second end (67) of the container portion (62) of the dust container (60), and the other end is connected to a dust collection box (90) described later. The transfer duct (88) is made of a flexible tube.

In the dust transfer section (80), the damper (82) in the damper box (81) is closed in normal operation of performing cooling and heating (see, FIG. 11(A)). Therefore, the air blowing from the indoor fan (21) does not enter the damper box (81). In the dust transfer section (80), the damper (82) in the damper box (81) is opened in transferring the dust in the dust container (60) to the dust collection box (90) (see, FIG. 11(B)). This allows the air blowing from the indoor fan (21) to enter the dust container (60) through the entrance duct (86) and the damper box (81). As a result, the dust in the dust container (60) is transferred to the dust collection box (90) together with the air through the transfer duct (88). That is, the dust in the dust container (60) is discharged. Further, in the dust transfer section (80), the damper (82) in the damper box (81) is closed when the dust in the dust collection box (90) is discharged to outside the casing (10) (see, FIG. 11(C)). In this case, suction by a cleaner through the cleaner insertion hole causes the dust in the dust collection box (90) to be sucked into the cleaner through the transfer duct (88), the damper box (81), and the suction duct (87). That is, the dust transfer section (80) is configured to transfer the dust in the dust container (60) to a predetermined location using the air blowing from the indoor fan (21).

As described above, the dust collection box (90) contains the dust transferred from the dust container (60) as shown in FIGS. 1 and 2. The dust collection box (90) is in the shape of a rather narrow, substantially rectangular parallelepiped, and is disposed below the partition plate (25) as the dust container (60) is. The dust collection box (90) is disposed along one of the sides of the partition plate (25) so as not to overlap with the air filter (30) when viewed in plan. An end of the dust collection box (90) opposite the end thereof connected to the transfer duct (88) serves as an exhaust port (91). A portion of the dust collection box including the exhaust port (91) penetrates the casing (10) to communicate with the inside of the room. A sealing member (93) is provided at the penetrating portion of the exhaust port (91).

The portion of the dust collection box (90) including the exhaust port (91) is smaller in area than the other portion when viewed in plan. A side plate of the dust collection box (90) close to the air filter (30) is curved to correspond to the outer circumference of the air filter (30). A filter (91) is provided in the portion of the dust collection box (90) near the exhaust port (91). In transferring the dust from the dust container (60) to the dust collection box (90), the air inside the box is discharged from the exhaust port (91). In this case, the filter (92) prevents the transferred dust from flowing out of the exhaust port (91). When the dust is discharged from the dust collection box (90) by suction of a cleaner, the indoor air enters the dust collection box (90) through the exhaust port (91). Dust contained in the entered air is trapped on the filter (92). In this way, air supply/exhaust through the exhaust port (91) keeps a good pressure balance in the dust collection box (90), thereby appropriately transferring and discharging the dust to and from the dust collection box (90).

—Working Mechanism—

Figure 12:
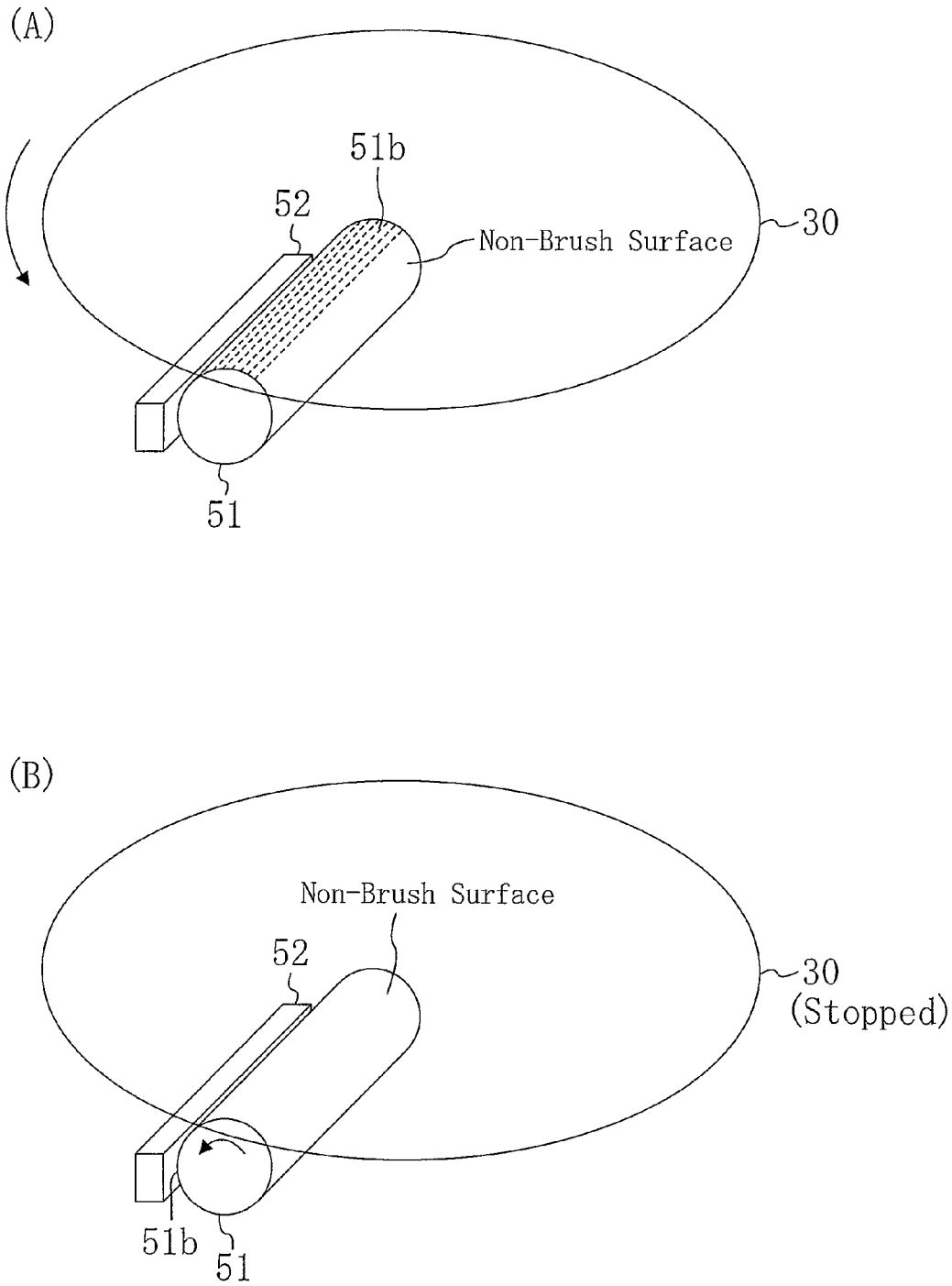
FIG. 12 shows views schematically illustrating relationships between the air filter and the dust removing section of the embodiment.
Figure 13:
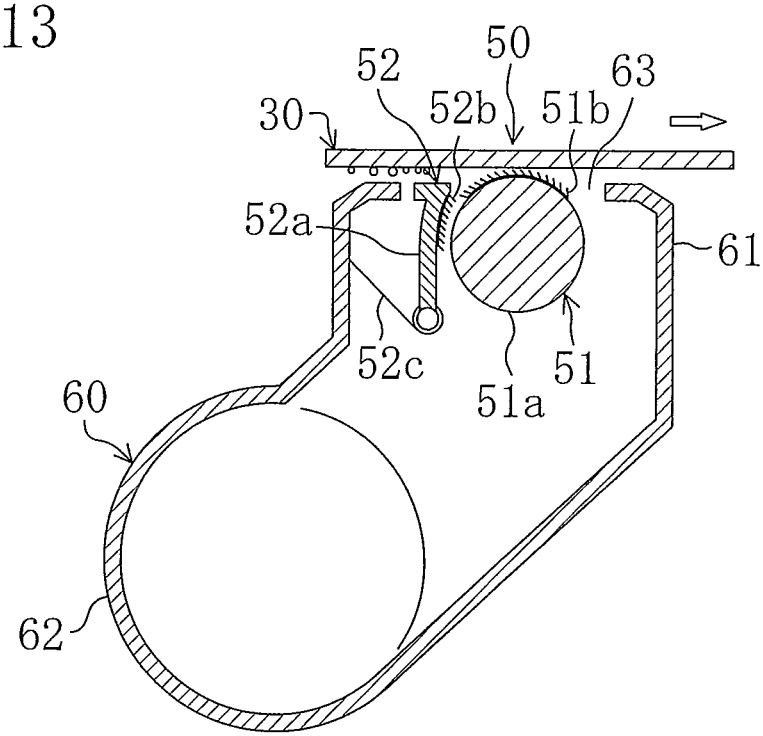
FIG. 13 is a lateral cross-sectional view illustrating a relationship between the air filter and the dust removing section in dust removal operation of the embodiment.

A working mechanism of the indoor unit (1) will be described with reference to FIGS. 12-14. The indoor unit (1) is capable of switchably performing normal operation of cooling/heating the room, and filter cleaning operation of cleaning the air filter (30).

<Normal Operation>

In the normal operation, as shown in FIG. 12(B), the rotating brush (51) is rotated such that the bristle portion (51*b*) is located close to the cleaning brush (52). Specifically, the rotating brush (51) is rotated to a position at which the bristle portion (51*b*) of the rotating brush (51) is not in contact with the air filter (30), thereby causing a surface of the rotating brush (51) without bristles (i.e., a circumferential surface of the shaft (51*a*) on which the bristle portion (51*b*) is not formed) to face the air filter (30). The damper (82) in the damper box (81) is closed (i.e., in the state shown in FIG. 11(A)). At this time, the air filter (30) is stopped.

In this state, the indoor fan (21) is driven. Then, indoor air sucked into the indoor unit (1) through the inlet (13) passes through the air filter (30), and enters the bell mouth (24). When the air passes through the air filter (30), dust contained in the air is trapped on the mesh member (37) of the air filter (30). The air entered the bell mouth (24) blows from the indoor fan (21). The blowing air is cooled or heated as a result of heat exchange with a refrigerant in the indoor heat exchanger (22), and is supplied to the inside of the room through the outlets (14). Thus, the room is cooled or heated. In this operation, since the damper (82) in the damper box (81) is closed, air blowing from the indoor fan (21) does not enter the dust container (60) through the damper box (81).

In this manner, in the normal operation, the bristle portion (51*b*) of the rotating brush (51) and the air filter (30) are not in contact with each other. That is, the bristle portion (51*b*) is separated from the air filter (30). This configuration can prevent degradation of the bristle portion (51*b*) due to constant contact with the air filter (30), thereby improving durability of the rotating brush (51).

<Filter Cleaning Operation>

In the filter cleaning operation, the compressor is stopped, and the refrigerant does not circulate in the refrigerant circuit. In this filter cleaning operation, "dust removal operation," "brush cleaning operation," "dust transfer operation," and "dust discharge operation" are switchably performed.

The "dust removal operation" is performed to remove dust trapped on the air filter (30). The "brush cleaning operation" is performed to remove dust trapped on the rotating brush (51). The "dust transfer operation" is performed to transfer dust from the dust container (60) to the dust collection box (90). The "dust discharge operation" is performed to discharge the dust in the dust collection box (90) to outside the casing (10).

In this embodiment, the "dust removal operation" and the "brush cleaning operation" are alternately performed. First, in the "dust removal operation," the indoor fan (21) is stopped. Then, as shown in FIG. 12(A), the rotating brush (51) is rotated to bring the bristle portion (51*b*) into contact with the air filter (30). In this state, the air filter (30) is rotated in the direction of an arrow indicated in FIG. 12(A) (i.e., the counterclockwise direction). Specifically, as shown in FIG. 13, the air filter (30) moves in a direction opposite the inclination of the bristles of the bristle portion (51*b*) of the rotating brush (51). The rotating brush (51) is kept stopped.

As a result, dust on the air filter (30) is trapped on the bristle portion (51*b*) of the rotating brush (51) (see, FIG. 14(A)). Then, when the lever (44*a*) of the limit switch (44) of the filter drive means (40) is actuated, the filter drive motor (41) stops, thereby stopping the air filter (30). That is, the air filter (30) is stopped after rotating by a predetermined angle. In this way, the dust remaining on part of the air filter (30) that has passed over the bristle portion (51*b*) of the rotating brush (51) is removed. Since the bristles of the bristle portion (51*b*) are inclined in the direction opposite the direction of rotation (movement) of the air filter (30), the dust on the air filter (30) is easily scraped by the bristle portion (51*b*). Accordingly, the efficiency in removing dust by the rotating brush (51) is increased. When the air filter (30) stops, the "dust removal operation" is switched to the "brush cleaning operation."

Figure 14:
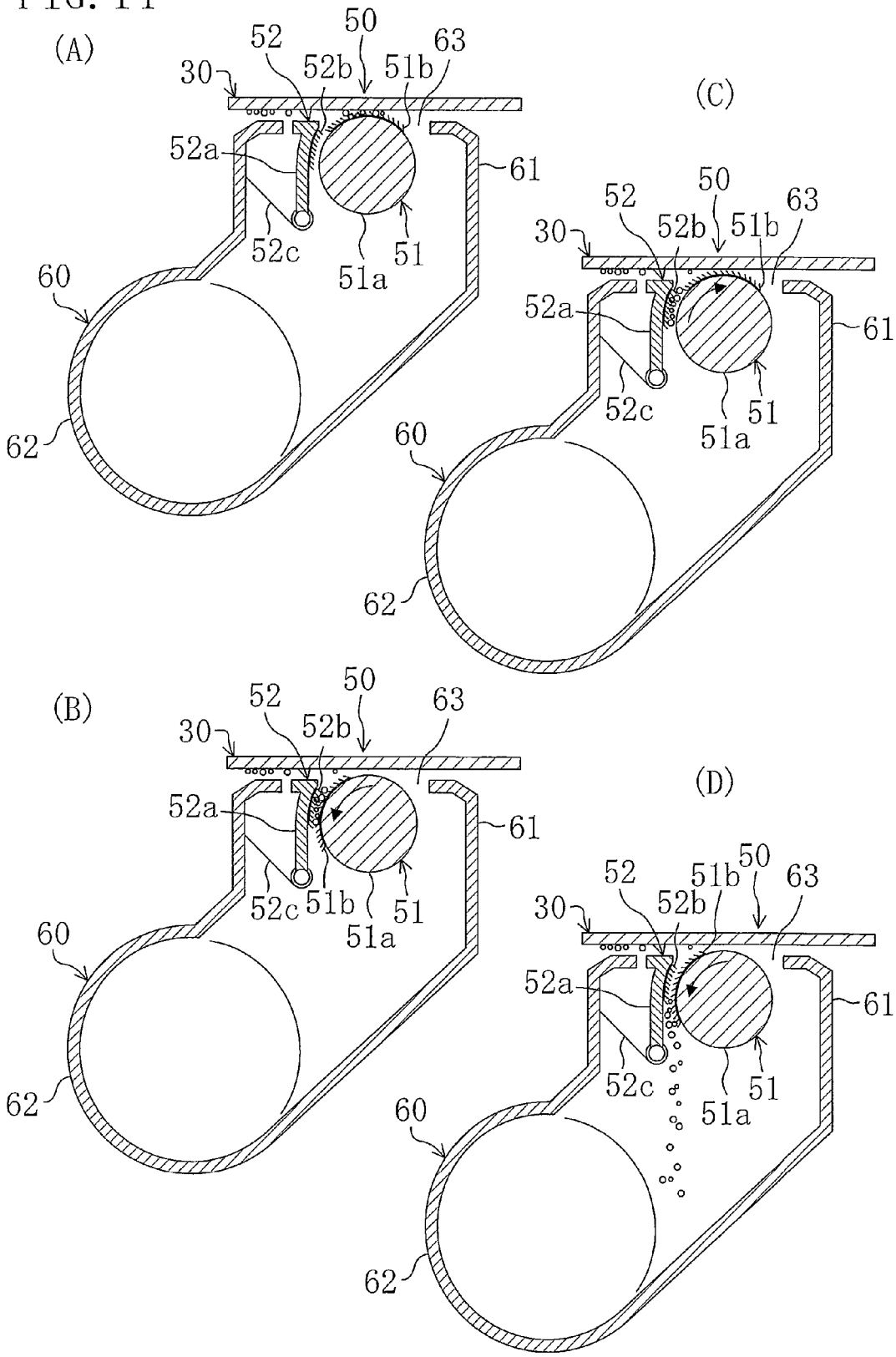
FIG. 14 shows lateral cross-sectional views illustrating operation of the dust removing section in brush cleaning operation of the embodiment.

In the "brush cleaning operation," the indoor fan (21) remains stopped, and first, the rotating brush (51) rotates to the left (i.e., counterclockwise) in FIG. 14. At this time, the rotating brush (51) rotates with the dust kept trapped on the bristle portion (51*b*). While rotation of the rotating brush (51), the bristle portions (51*b*, 52*b*) of the rotating brush (51) and the cleaning brush (52) are in contact with each other (see, FIG. 14(B)). Then, the rotating brush (51) stops after rotating by a predetermined rotation angle.

Subsequently, the rotating brush (51) rotate in the direction opposite the above-described direction (i.e., to the right (clockwise) in FIG. 14). Then, the dust trapped on the bristle portion (51*b*) of the rotating brush (51) is removed by the bristle portion (52*b*) of the cleaning brush (52) (see, FIG. 14(C)). This is because of the following reasons. Since the bristles of the bristle portion (52*b*) of the cleaning brush (52) are inclined downward, i.e., in a direction opposite the direction of rotation of the rotating brush (51), the dust is scraped from the bristle portion (51*b*) of the rotating brush (51). The bristle portions (51*b*, 52*b*) in contact with each other push the body (52*a*) of the cleaning brush (52) rearward, but the spring (52*c*) biases the body (52*a*) toward the rotating brush (51). Therefore, the bristle portions (51*b*, 52*b*) do not separate from each other, thereby appropriately pressing the cleaning brush (52) to the rotating brush (51). This process ensures removal of the dust from the bristle portion (51*b*) of the rotating brush (51). In this way, the dust is trapped on the bristle portion (52*b*) of the cleaning brush (52). The rotating brush (51) rotates to return to the original state (i.e., the state of FIG. 14(A)), and then stops.

Then, the rotating brush (51) rotates to the left (i.e., counterclockwise) again by a predetermined rotation angle. As a result, the dust trapped on the bristle portion (52*b*) of the cleaning brush (52) is scraped by the bristle portion (51*b*) of the rotating brush (51), and falls in the container portion (62) of the dust container (60) (see, FIG. 14(D). Since the bristles of the bristle portion (51*b*) of the rotating brush (51) are inclined toward the rotation direction, the dust is reliably scraped from the bristle portion (52*b*) of the cleaning brush (52). In this case, as described above, the spring (52*c*) suitably presses the cleaning brush (52) onto the rotating brush (51), thereby further ensuring removal of the dust from the cleaning brush (52). In this way, the dust trapped on the rotating brush (51) is removed, and is contained in the container portion (62) of the dust container (60). Then, the rotating brush (51) rotates to the right (i.e., clockwise) again to return to the original state (i.e., the state of FIG. 14(A)), and the "brush cleaning operation" is finished.

Once the "brush cleaning operation" is finished, the "dust removal operation" is performed again. Specifically, the air filter (30) is rotated again, and is stopped when the lever (44*a*) of the limit switch (44) is actuated again. As a result, the dust on part of the air filter (30) that has passed over the bristle portion (51*b*) of the rotating brush (51) is trapped on the bristle portion (51*b*) of the rotating brush (51) (i.e., the state shown in FIG. 14(A)). In this way, the "dust removal operation" and the "brush cleaning operation" are alternately performed. As a result, the dust is removed sequentially from predetermined parts of the air filter (30). When the dust is removed from every part of the air filter (30), the "dust removal operation" and the "brush cleaning operation" are completely finished. For example, when the lever (44*a*) of the limit switch (44) is actuated a predetermined number of times, the system determines that the air filter (30) has made a single turn. Then, the operations are finished.

In the "dust removal operation" and "brush cleaning operation" described above, the dust amount detection section (70) detects the amount of dust contained in the dust container (60). That is, the light intensity of an LED (72) is detected by a phototransistor (73). When the light intensity detected by the phototransistor (73) decreases to a set value (i.e., a lower limit) or less, it is determined that the amount of dust in the dust container (60) has reached a predetermined value. Then, the operation is switched to the "dust transfer operation."

In the "dust transfer operation," the rotating brush (51) is stopped in the state shown in FIG. 14(A), and the air filter (30) is stopped. The damper (82) in the damper box (81) is opened (i.e., the state shown in FIG. 11(B)). The indoor fan (21) is driven in this state. The air blowing from the indoor fan (21) sequentially passes through the entrance duct (86) and the damper box (81), and enters the dust container (60). This operation transfers the dust in the dust container (60) to the dust collection box (90) together with the air through the transfer duct (88). Then, the dust amount in the dust container (60) decreases, and the light intensity detected by the phototransistor (73) increases. When the detected light intensity increases to a set value (i.e., an upper limit) or higher, the system determines that the dust in the dust container (60) is almost discharged, and the "dust transfer operation" is finished. Thereafter, the "dust removal operation" or the "brush cleaning operation" is restarted.

In the filter cleaning operation of this embodiment, the "dust discharge operation" is performed under predetermined conditions. For example, the "dust discharge operation" is performed after the "dust transfer operation" is performed predetermined times (for a predetermined period), or may optionally be performed by a command sent by a user through a remote controller.

As in the "dust transfer operation" described above, in the "dust discharge operation," the rotating brush (51) is stopped in the state shown in FIG. 14(A), and the air filter (30) is stopped. Te damper (82) in the damper box (81) is closed (i.e., in the state shown in FIG. 11(C)). In this state, a user inserts a hose of a cleaner into the cleaner insertion hole in the decorative panel (11). This suction operation causes the dust in the dust collection box (90) to be sucked into the cleaner through the transfer duct (88), the dust container (60), and the suction duct (87) in this order. In this case, the dust in the dust container (60) is also sucked into the cleaner through the suction duct (87). As a result, the dust in the dust collection box (90) and the dust container (60) is discharged to outside the casing (10).

—Advantages of Embodiment—

As described above, in this embodiment, the air filter (30) and the rotating brush (51) are intermittently moved relative to each other for a predetermined area of the air filter (30) at each time. At each interval of the intermittent movement, dust on the rotating brush (51) is rotated by the cleaning brush (52). Specifically, the air filter (30) is intermittently moved by a predetermined angle at each time to remove dust, and brush cleaning operation is performed at each stop of the intermittent rotation. Then, a high efficiency in removing dust (i.e., a high dust removing performance) can be maintained for the entire air filter (30). This configuration ensures removal of dust from the entire air filter (30).

In this embodiment, in the normal operation in which the air filter (30) is not cleaned, the bristle portion (51*b*) of the rotating brush (51) and the air filter (30) are not in contact with each other. This configuration can prevent degradation of the bristle portion (51*b*) due to constant contact with the air filter (30) for a long period, thereby improving durability of the rotating brush (51) and maintaining the dust removal function for a long period.

In particular, in this embodiment, the bristle portion (51*b*) is formed in part of the rotating brush (51) in the circumferential direction. Thus, only rotation of the rotating brush (51) easily separates the rotating brush (51) and the air filter (30) from each other. In addition, since the bristle portion (51*b*) is provided only in part of the rotating brush (51) in the circumferential direction, the cost of materials for the bristle portion (51*b*) can be reduced, thereby reducing cost of the dust removing section (50).

Moreover, in this embodiment, the bristle portion (51*b*) of the rotating brush (51) is made of pile fabric. Accordingly, the bristle portion (51*b*) has short bristles, and thus, the area occupied by the rotating brush (51) can be reduced. Since the bristle portion (51*b*) has short bristles and the bristle portion (51*b*) is located only in part of the rotating brush (51) in the circumferential direction, the resistance to airflow (i.e., air blowing from the indoor fan (21)) can be reduced in the dust container (60). As a result, the transfer efficiency in the dust transfer operation and the discharge efficiency in the dust discharge operation can be increased.

Furthermore, inclined pile fabric is used as pile fabric. Thus, only reversal of the rotational direction of the rotating brush (51) enables dust trapped on the bristle portion (51*b*) to be easily removed by the cleaning brush (52). That is, only a change in the rotational direction of the rotating brush (51) can switch the rotating brush (51) between dust trapping operation and dust removing operation. Although simple, the foregoing structure ensures removal of dust on the air filter (30) to allow the dust to be contained in the dust container (60).

In this embodiment, the dust container (60) is located below the air filter (30), and thus, serves as a resistance to (i.e., disturbs) airflow. In view of this, in this embodiment, the dust collection box (90) is provided at a position at which the dust collection box (90) does not disturb airflow, and dust transfer operation of transferring dust in the dust container (60) to the dust collection box (90) is performed. Accordingly, dust removed from the air filter (30) can be eventually accumulated in the dust collection box (90), and thus, the size of the dust container (60) can be reduced. As a result, the resistance to air flow toward the air filter (30) can be reduced.

In the dust transfer operation, dust in the dust container (60) is transferred to the dust collection box (90) together with air blowing from the indoor fan (21). That is, dust is transferred using the existing indoor fan (21). This configuration eliminates the need for additionally providing a transfer section such as a suction fan, thereby reducing the size and cost of the unit.

In addition, in this embodiment, only insertion of a cleaner into the cleaner insertion port can allow dust in the dust collection box (90) and the dust container (60) to be sucked. Accordingly, dust on the air filter (30) can be easily disposed without greatly bothering a user.

—First Variation of Embodiment—

A first variation of the embodiment will be described hereinafter. In this variation, a modification is made to "brush cleaning operation" in the filter cleaning operation of the embodiment.

Figure 15:
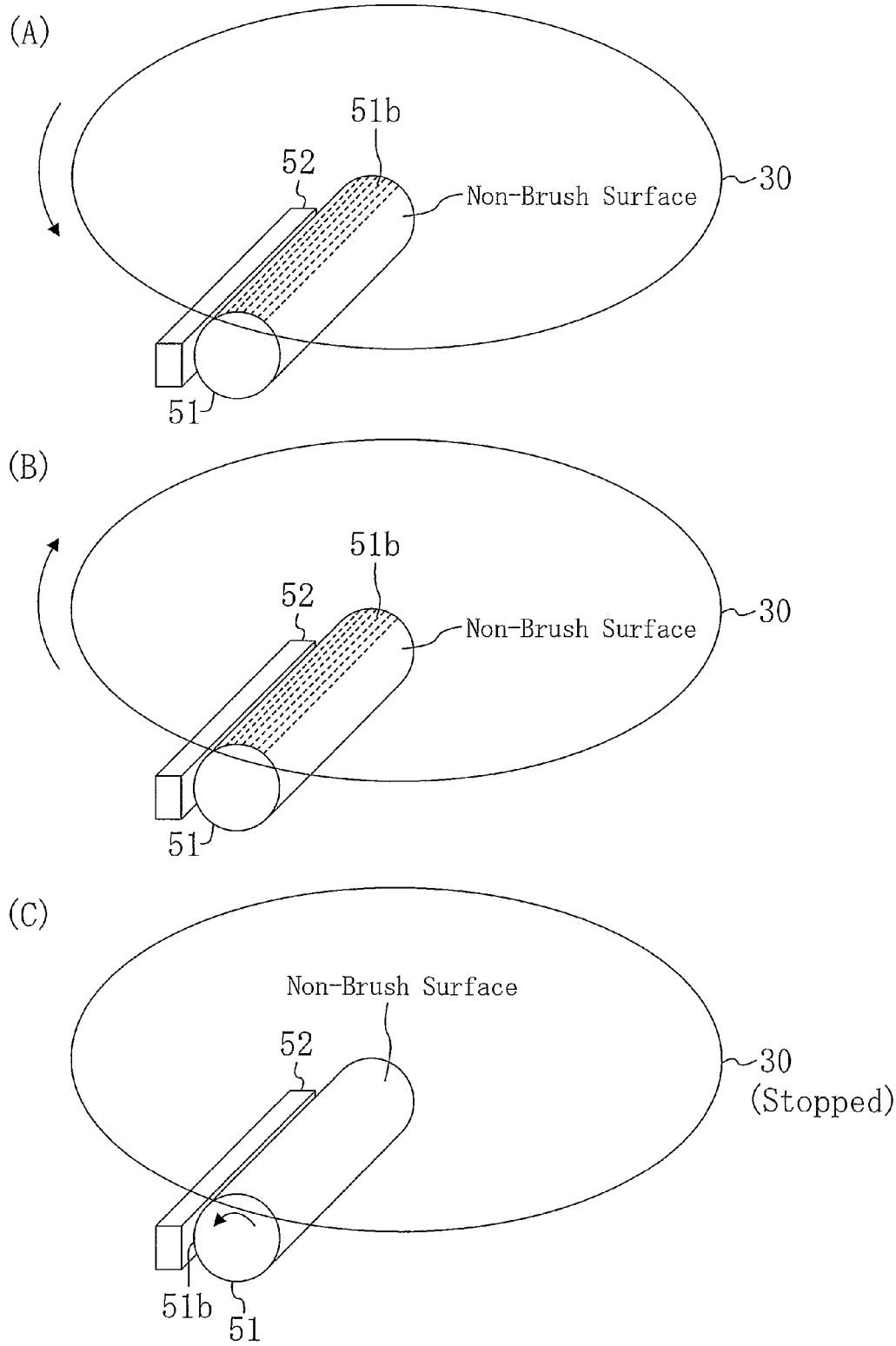
FIG. 15 shows views schematically illustrating relationships between an air filter and a dust removing section according to a first variation of the embodiment, FIGS. 15(A) and 15(B) respectively show states in filter cleaning operation.

Specifically, in the "dust removal operation" of this variation, as in the embodiment, the air filter (30) rotates in the direction of an arrow indicated in FIG. 15(A) (i.e., the counterclockwise direction), with the bristle portion (51*b*) of the rotating brush (51) being in contact with the air filter (30). Specifically, the air filter (30) moves in a direction opposite the inclination of the bristles of the bristle portion (51*b*). Then, the air filter (30) is stopped after rotating by a predetermined angle, and the operation is switched to the "brush cleaning operation."

In the "brush cleaning operation," as a feature of this variation, the rotating brush (51) remains stopped, and the air filter (30) first rotates in the direction of an arrow indicated in FIG. 15(B) (i.e., the clockwise direction). Specifically, the air filter (30) rotates in the reverse direction of the direction of rotation in the "dust removal operation," i.e., in the same direction as the inclination of the bristles of the bristle portion (51*b*). In this variation, the air filter (30) rotates to move to a distance corresponding to the width of the bristle portion (51*b*) of the rotating brush (51). As a result, the dust remaining between the air filter (30) and the bristle portion (51*b*), i.e., the dust almost separated from the air filter (30), uniformly adheres to the bristle portion (51*b*). Thus, the dust on the air filter (30) is reliably trapped on the bristle portion (51*b*). This process can increase the efficiency of dust removal by the rotating brush (51).

Thereafter, after reverse rotation of the air filter (30) as described above, the rotating brush (51) is rotated in the same process (shown in FIGS. 14(A)-14(D)) as in the "brush cleaning operation" of the embodiment. Specifically, in the "brush cleaning operation" of this variation, the air filter (30) first rotates in the direction opposite the direction of rotation in the "dust removal operation." In the "normal operation" of this variation, as in the embodiment, the bristle portion (51*b*) of the rotating brush (51) is positioned not to be in contact with the air filter (30) (see, FIG. 15(C)). Other configuration, operation, and advantages are the same as in the embodiment.

—Second Variation of Embodiment—

Then, a second variation of the embodiment will be described. The air filter (30) is rotated by a predetermined angle at each time in the "dust removal operation" of the filter cleaning operation in the embodiment, whereas in the second variation, the air filter (30) makes one or a plurality of turns. In this variation, after completion of the "dust removal operation," the "brush cleaning operation" is performed. That is, in this variation, the "dust removal operation" and the "brush cleaning operation" are not alternately performed, but the "dust removal operation" and the "brush cleaning operation" are performed in this order once for each of the operations.

In this case, in the "dust removal operation," when the air filter (30) rotates, dust on the air filter (30) is trapped by the bristle portion (51*b*) of the rotating brush (51). Then, when the air filter (30) makes a single turn, for example, the lever (44*a*) of the limit switch (44) of the filter drive section (40) is actuated. With this actuation, the air filter (30) stops, and the "dust removal operation" is finished. This "dust removal operation" removes dust from the entire air filter (30). After the "dust removal operation," the operation is switched to the "brush cleaning operation." In this "brush cleaning operation," as in the embodiment, dust trapped on the rotating brush (51) is scraped by the cleaning brush (52).

In this manner, in this variation, after completion of dust removal from the air filter (30), dust attached to the rotating brush (51) is removed. Accordingly, at a start of next filter cleaning operation, no dust is attached to the rotating brush (51). Thus, a sophisticated dust removal function can be obtained immediately after a start of the "dust removal operation." As a result, the time necessary for cleaning the air filter (30) can be reduced. Other configuration, operation, and advantages are the same as in the embodiment.

—Third Variation of Embodiment—

Then, a third variation of the embodiment will be described. Although not shown, in this variation, the rotation angle of the air filter (30) in the "dust removal operation" of the filter cleaning operation is adjusted. Specifically, in this variation, the rotation angle of the air filter (30) (i.e., a predetermined area from which dust is intermittently removed) in the "dust removal operation" is adjusted depending on the amount of dust attached to the air filter (30).

In this variation, when the amount of dust attached to the air filter (30) is large, for example, the rotation angle of the air filter (30) is reduced. That is, when the amount of dust attached to the air filter (30) is large, the amount of rotation of the air filter (30) at each time is small, and thus, a small area of the air filter (30) passes over the rotating brush (51) at each time. Consequently, the area from which dust is scraped by the rotating brush (51) at each time is small. When the amount of dust attached to the air filter (30) is large, the amount of dust which needs to be scraped at one turn of the air filter (30) is also large. Then, since the rotating brush (51) has a limitation in the amount of dust scraped by the rotating brush (51) at each time, the rotating brush (51) might fail to scrape the dust. In this case, even with further rotation of the air filter (30), dust cannot be scraped any more, and remains on the air filter (30). In contrast, in this variation, when the amount of dust attached to the air filter (30) is large as described above, the rotation angle of the air filter (30) at each time is small, and thus, the area from which dust is scraped at each time is small. Accordingly, a situation in which the rotating brush (51) cannot scrape dust in one turn of the air filter (30) can be avoided. This operation further ensures removal of dust from the entire air filter (30). As a result, the reliability is enhanced. In this manner, in this variation, even when the amount of dust attached to the air filter (30) is large, the rotation angle of the air filter (30) at each time is reduced to maintain a dust removal capability (i.e., a dust scraping capability) of the rotating brush (51).

For example, in an indoor unit (1), two types, i.e., large and small, of the rotation angle of the air filter (30) in the "dust removal operation" are determined, and a user selects one of the two types of the rotation angle through a remote controller. For example, in an environment of a small amount of dust, the "larger rotation angle" is selected, whereas in an environment of a large amount of dust, the "smaller rotation angle" is selected.

Other Embodiments

The foregoing embodiment may be changed in the following manner.

For example, in the foregoing embodiment, the air filter (30) is rotated relative to the rotating brush (51) in the dust removal operation in the filter cleaning operation. Alternatively, the dust container (60) (including the rotating brush (51) and the cleaning brush (52)) may be moved relative to the air filter (30). In this case, the dust container (60) revolves about the axis receiver (33) of the air filter (30). In other words, according to the present invention, the air filter (30) and the rotating brush (51) move relative to each other in the dust removal operation.

In the foregoing embodiment, the air filter (30) is circular. However, the present invention is not limited to this shape, and the air filter (30) may be rectangular. In this case, for example, the air filter (30) moves linearly with respect to the rotating brush (51).

In the foregoing embodiment, in the normal operation, rotation of the rotating brush (51) separates the bristle portion (51*b*) from the air filter (30). Alternatively, in the present invention, the bristle portion (51*b*) may be separated from the air filter (30) by moving the rotating brush (51) downward. That is, in this case, the rotating brush (51) is configured to be vertically movable. Alternatively, the bristle portion (51*b*) may also be separated from the air filter (30) by moving the rotating brush (51) upward.

In the foregoing embodiment, the indoor unit (1) is provided on the ceiling of the room. However, the present invention is not limited to this configuration, and is also applicable to an indoor unit provided on a wall of the room, i.e., an indoor unit of a wall hanging type.

In the foregoing embodiment, air blowing from the indoor fan (21) before passing through the indoor heat exchanger (22) enters the damper box (81). Alternatively, in the present invention, air which has passed through the indoor heat exchanger (22) may enter the damper box (81) to perform dust transfer operation in the same manner. In this case, in cooling operation, for example, air cooled in the indoor heat exchanger (22) flows in, for example, the dust container (60), and thus, condensation might occur in, for example, the dust container (60). Accordingly, in this case, to prevent such condensation, the dust container (60) and the ducts (86, 88) may be covered with a heat insulator.

The above-described embodiments are provided as preferred examples in nature, and are not intended to limit the scope, applications, and use of the invention.

INDUSTRIAL APPLICABILITY

As described above, the present invention is useful for an indoor unit of an air conditioner having a dust removal function of removing dust on an air filter with a rotating brush.

The invention claimed is:

1. An indoor unit of an air conditioner in which an indoor heat exchanger, an indoor fan, and an air filter disposed on an inlet side of the indoor fan are provided in a casing, the indoor unit comprising:

a brush member configured to come into contact with the air filter to scrape dust from the air filter;

a cleaning brush member configured to come into contact with the brush member to remove dust from the brush member;

a drive controller configured to intermittently move the air filter and the brush member relative to each other to scrape dust from the air filter with the brush member for a predetermined area at each time in the entire air filter, the predetermined area being smaller than an entire area of the air filter; and a brush drive controller configured to bring the brush member and the cleaning brush member into contact with each other to remove dust from the brush member with the cleaning brush member after each stop of the intermittent relative movement of the air filter and the brush member.

2. The indoor unit of claim 1, wherein the air filter has a disc shape, the brush member includes a shaft and a bristle portion provided on an outer circumferential surface of the shaft and configured to scrape dust, is located upstream of the air filter, and extends in a radial direction of the air filter, the drive section intermittently rotates the air filter by a predetermined rotation angle corresponding to the predetermined area at each time, with the bristle portion of the brush member being in contact with the air filter, and the brush drive section rotates the brush member about an axial center of the shaft after each stop of the intermittent rotation of the air filter by the drive section, to remove dust from the brush member with the cleaning brush member.

3. The indoor unit of claim 1 or 2, wherein the predetermined area for the intermittent relative movement of the air filter and the brush member by the drive section is adjusted depending on an amount of dust attached to the air filter.

4. The indoor unit of claim 2, wherein the brush drive section is configured to rotate the brush member after completion of the rotation of the air filter by the drive section, to remove dust from the brush member with the cleaning brush member.

5. The indoor unit of claim 2, wherein the bristle portion of the brush member is made of pile fabric.

6. The indoor unit of claim 5, wherein the bristle portion of the brush member is made of inclined pile in which bristles of the bristle portion are inclined in a direction opposite a direction of the relative movement of the air filter.

7. The indoor unit of claim 2, wherein the bristle portion of the brush member is made of inclined pile fabric of pile fabric in which bristles of the bristle portion are inclined in a direction opposite a direction of the relative movement of the air filter, and the cleaning brush member has a bristle portion made of inclined pile fabric in which bristles of the bristle portion are inclined in a direction opposite a direction of inclination of the bristles of the bristle portion of the brush member, and configured to come into contact with the bristle portion of the brush member to remove dust from the bristle portion.

8. The indoor unit of claim 2, wherein the bristle portion of the brush member is made of inclined pile fabric of pile fabric in which bristles of the bristle portion are inclined in a direction, and the drive section is configured to stop after rotating the air filter in a direction opposite a direction of inclination of bristles of the bristle portion and then reversely rotating the air filter by a predetermined rotation angle.

9. The indoor unit of claim 1, further comprising:

a dust container located upstream of the air filter, including the brush member and the cleaning brush member, and configured to contain dust removed by the cleaning brush member; and a dust transfer section configured to introduce air blowing from the indoor fan into the dust container, and transfer dust in the dust container to a predetermined place, together with the blowing air.

* * * * *